US012258831B1

(12) United States Patent
Nebiolo et al.

(10) Patent No.: US 12,258,831 B1
(45) **Date of Patent: *Mar. 25, 2025**

(54) DOWN-HOLE EXTENDED REACH TOOL GENERATING VARIABLE SHOCK WAVE AMPLITUDES

(71) Applicant: Proshale LLC, Spring, TX (US)

(72) Inventors: Martin Mauro Nebiolo, Neuquen Capital (AR); Christian Brendstrup, Neuquen Capital (AR); Christian Cerne, Spring, TX (US); Gustavo Dietrich, Neuquen Capital (AR)

(73) Assignee: PROSHALE LLC, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/800,101

(22) Filed: Aug. 11, 2024

Related U.S. Application Data

(63) Continuation of application No. 18/385,419, filed on Oct. 31, 2023, now Pat. No. 12,152,454.

(51) Int. Cl.
*E21B 34/10* (2006.01)
*E21B 31/00* (2006.01)

(52) U.S. Cl.
CPC ..... *E21B 31/005* (2013.01); *E21B 34/10* (2013.01); *E21B 2200/05* (2020.05)

(58) Field of Classification Search
CPC ..... E21B 31/005; E21B 34/10
See application file for complete search history.

(56) References Cited

U.S. PATENT DOCUMENTS

| | | | | |
|---|---|---|---|---|
| 5,794,729 | A | 8/1998 | Van Meter | |
| 7,866,397 | B2 | 1/2011 | Lee | |
| 8,783,338 | B1 | 7/2014 | Ferguson et al. | |
| 9,494,014 | B1 | 11/2016 | Manke et al. | |
| 10,677,024 | B2 | 6/2020 | Schultz | |
| 12,154,454 | B2 * | 11/2024 | Nebiolo | E21B 31/005 |
| 2014/0069648 | A1 | 3/2014 | Dotson et al. | |
| 2017/0114601 | A1 | 4/2017 | Montiel | |
| 2022/0341288 | A1 * | 10/2022 | Storie | E21B 21/103 |

FOREIGN PATENT DOCUMENTS

| | | |
|---|---|---|
| CA | 3036840 | 4/2020 |

* cited by examiner

*Primary Examiner* — Cathleen R Hutchins
*Assistant Examiner* — Ronald R Runyan
(74) *Attorney, Agent, or Firm* — Eric P. Mirabel JD, LLM

(57) ABSTRACT

A fluid-driven multi-mode extended reach vibration tool is selectively operable to control generating shock waves of different amplitudes by a downhole motor or shock-wave generating tool. Interrupting and then reinstating flow of pressurized fluid through the tool enables switching between different shock wave amplitudes, as such causes rotation of a slot piston to successive positions and enables it to unblock designated fluid ejection paths, while blocking others. Blocking different flow paths and unblocking others allows generating different internal pressures and shock wave amplitudes under the externally-applied fluid pressure downhole. There is also an "off" mode with no vibration, while maintaining well control and fluid pressure at the BHA.

20 Claims, 18 Drawing Sheets

DOWN-HOLE EXTENDED REACH TOOL GENERATING VARIABLE SHOCK WAVE AMPLITUDES

BACKGROUND

During the advancing of a drill bit in subterranean horizontal drilling operations or interventions in cased wells, friction between the string and the well sides can impair the advancing of said string and the BHA. In some circumstances, the weight of the drill plus the force applied from surface to push the string downhole is not sufficient to overcome the friction.

In operations where mud-motor is part of the BHA used to rotate the drill bit. Mud motors are necessary where the string is composed of coiled or flexible tubing. However due to its inherent transverse flexibility, coiled tubing is generally more susceptible to buckling than drill strings consisting of rigid connected pipe sections. Extended reach tools are used in conjunction with coiled tubing to remedy this disadvantage.

During operations in horizontal wells, additional loads are placed on the coiled tubing, making it more difficult to advance toward the bottom of the wellbore. Extended-reach tools continuously generate shock waves to overcome downhole friction and allow the string to continue to move forward. These extended-reach tools preferably generate continuous vibration through shock waves that reduce the friction coefficient between the string and inner diameter of the wellbore, and are usually located near the BHA.

Continual or repeated exposure to large amplitude pressure pulses and vibration generated by extended reach tools may be detrimental to the BHA and the string life, or sometimes even surface equipment. Of course, large amplitude shockwaves may be needed during extended reach or horizontal drilling to prevent lock-up. Thus, variable amplitude shockwaves are desirable to help increase equipment life, particularly BHA life. See also Background of AU 2012256028 B2 and CA 3036840, explaining the field in more detail.

Hence there is a need for an improved downhole tool which would control generation of vibrations of different amplitudes and/or frequencies and could run high-pressure fluid in an "off" mode (where there are no significant vibrations) as well. It would provide advantages associated with reductions of such vibrations and still allow the tool to remain in position without tripping the pipe. If using rigid drill pipe, one must pull up the drill string in relatively short sections, each of which are disconnected in sequence, and then stack them in a rack. If using coiled tubing, one still needs to bring up an extended length of it, and although this is done in a motorized process where it's coiled on a drum, it's still time-consuming and thus expensive.

SUMMARY

The present invention discloses an improved fluid-driven multi-mode vibration tool which is operated by blocking then reinstating the flow of pressurized fluid through it, thereby being able to selectively provide vibrations of different amplitudes from shock waves generated by a downhole motor or other tool; operable, for example, in high, low, and off modes of amplitude. In the 'high' amplitude mode, there are larger amplitude vibrations than in the 'low' mode; and the 'off' modes only results in negligible, insignificant vibrations.

The tool has an upper sub joined to a lower sub, where the lower sub has at least two pairs of opposed exit ports on its outer surface. A first pair of the pairs of opposed exit ports includes a nozzle at the exit port terminus. The upper and lower subs both have aligned central bores. The central bore of the lower sub houses a shaft with at least three pairs of opposed ejection paths extending through it, each of the opposed ejection paths having an entrance and an exit, and wherein the exits of the first pair of opposed ejection paths align with the members (and the nozzles) of the first pair of opposed exit ports on the lower sub and access the central bore of the lower sub, the exits of the second pair of opposed ejection paths access the central bore of the lower sub, and then exits of the third pair of opposed ejection paths align with the members of the second pair of opposed exit ports on the lower sub.

A slot piston which is slidable axially between lower and upper positions within the central bore of the lower sub, is located above the shaft. One or more blocked and one or more unblocked flow paths extend through the slot piston. Each blocked and each unblocked flow path has an entrance and an exit. The exit of each blocked and each unblocked flow path can align with an entrance of the opposed ejection paths. The exit of each blocked flow path includes a seal, which can seal the entrance to the opposed ejection paths when aligned and when the slot piston is at its lower position adjacent the shaft.

The center of the shaft and the center of the slot piston each include a well. A spring which is configured to resist downward movement of the slot piston is held in place between these wells. A centralizer, fixed in the lower end of the upper sub, is placed above the slot piston. A series of channels, each having an entrance and an exit, extend through the centralizer. The centralizer further includes an axially extending central channel accommodating a stabilizing rod which is fixed to the center of the slot piston. The stabilizing rod extends axially into a tubular cup fixed to and extending axially from the upper side of the centralizer.

A ratchet sleeve, including a pair of mating ratchet rings, wherein each ratchet ring has an opposed irregular edge with peaks and valleys, is placed between the lower end of the upper sub and the upper end of the shaft. The ratchet rings are installed within the sleeve in a manner such that the irregular edges are placed slightly spaced but lie matingly while opposed. A distal edge from the irregular edge surface of one of the ratchet rings lies adjacent to the lower end of the upper sub and a distal edge of the other ring lies adjacent to the upper end of the shaft.

The ratchet sleeve and the pair of mating ratchet rings surround the slot piston, and a series of protrusions on the circumference of the slot piston extend between the mating region of the ratchet rings. The slot piston is movable axially with respect to the pair of opposed ratchet rings (and the ratchet sleeve) in a manner such that longitudinal force on the slot piston causes it to rotate with respect to the upper sub and then set in one of a series of specified positions where the protrusions lie in a valley of either of the opposed ratchet rings, and wherein, changes in fluid pressure cause axial and rotational movement of the slot piston and opening and closing of different pairs of ejection paths and control selection of different vibrational amplitudes, generated by a downhole motor or a shock-wave generating tool located below the fluid-driven multi-mode vibration tool.

Embodiments of the present invention will be discussed in greater details with reference to the accompanying figures in the detailed description which follows.

Figure 1:
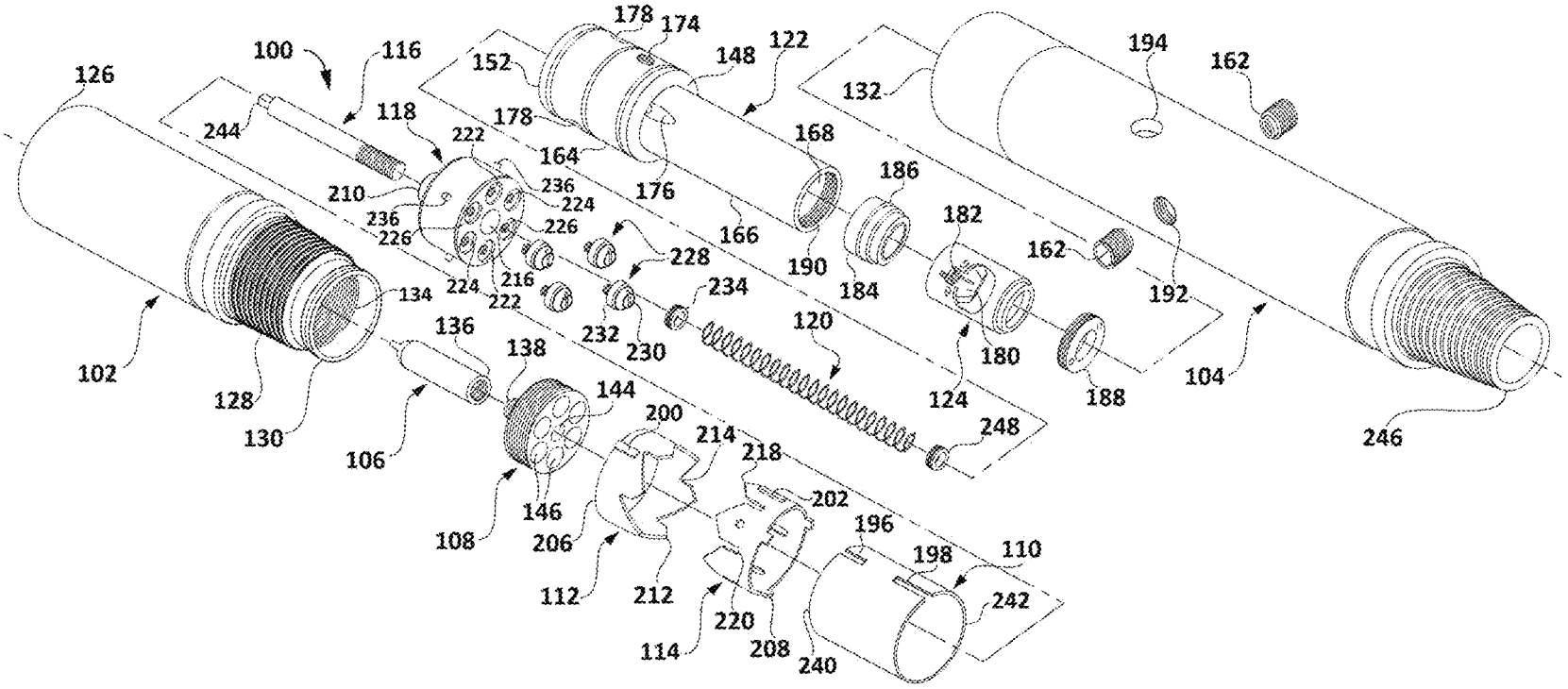
FIG. 1 is an exploded view of a first embodiment of a fluid-driven multi-mode vibration tool in accordance with the present invention.

It should be understood that the drawings and the associated descriptions below are intended to illustrate one or more embodiments of the present invention, and not to limit the scope or the number of different possible embodiments of the invention.

In the description of the invention which follows, unless specified otherwise, terms 'upper', 'upward' and 'upwards' are used to denote a direction upwards towards top of the well-bore or towards the source of fluid flowing through the tool. Similarly, terms 'lower', 'downward' and 'downwards' are used to denote a direction downwards towards the base of the well-bore or towards the direction of fluid flowing through the tool, which is left to right in all figures.

Some components and/or portions of the embodiments of the invention illustrated in the figures may not be fully discussed in the description which follows, because they are not needed to provide a full and complete description of the embodiments of the invention, which is adequate for comprehension by anyone with relevant experience in the field.

It should be noted that the drawings are not necessarily drawn to scale.

DESCRIPTION

Reference will now be made in detail to a first embodiment of a fluid-driven multi-mode vibration tool device of the invention with reference to the accompanying figures. A first embodiment of the fluid-driven multi-mode vibration tool 100, as shown in the exploded view of FIG. 1, includes an upper sub 102, a lower sub 104, a tubular cup 106, a centralizer 108, a ratchet sleeve 110, an upper ratchet ring 112, a lower ratchet ring 114, a stabilizing rod 116, a slot piston 118, a spring 120, a shaft 122, and a flapper valve 124. Other parts in FIG. 1 are discussed below.

When an assembled fluid-driven multi-mode vibration tool 100 is installed in a well-bore, an internally threaded upper end 126 of the upper sub 102 is fixed with the string or coiled tubing (or other equipment assembly in the well-bore) to receive fluid inflow. After entering tool 100, the fluid exits through lower end 246 of lower sub 104 and gets delivered into the BHA, or other equipment assembly, connected to the externally threaded region of lower end 246.

The upper sub 102 is screwed with the lower sub 104 such that the central bore 140 of the upper sub 102 is axially aligned with the central bore 142 of the lower sub 104 (See FIGS. 2A-2C, and 6A to 8C). As illustrated in figures, an externally threaded region 128 towards the lower end 130 of the upper sub 102 is screwed with an internally threaded upper end 132 of the lower sub 104.

The lower sub 104 further includes a first pair of opposed and internally threaded exit ports 192, and a second pair of opposed exit ports 194, as also shown in FIG. 1.

An externally threaded nozzle 162 is screwed into each member of opposed exit ports 192. The externally threaded centralizer 108 is screwed into an internally threaded region 134 towards the lower end 130 of the upper sub 102.

The centralizer 108 includes an axially extending central channel 144, the upper end of which extends in a protrusion 138 at the upper end of the centralizer 108. Centralizer 108 further includes six parallel flow channels 146 which extend longitudinally through centralizer 108 and symmetrically surround the central channel 144. An internally threaded lower end 136 of the hollow tubular cup 106 is screwed over the mating threads of externally threaded surface of protrusion 138. The tubular cup 106 extends axially upwards into the core 140 of the upper sub 102.

The shaft 122 is installed within the central bore 142 of the lower sub 104, by resting the lower edge of its flare 148 against an annular restriction 150 (See FIGS. 2A-2C, and 6A to 8C) on the internal surface of the lower sub 104.

A ratchet assembly, including a ratchet sleeve 110 and a pair of mating ratchet rings, namely, an upper ratchet ring 112 and a lower ratchet ring 114, rests between the lower end 130 of upper sub 102 and upper end 152 of shaft 122. The ratchet assembly prevents upward movement of shaft 122. Shaft 122 is locked against the downward displacement by annular restriction 150.

Figure 3A:
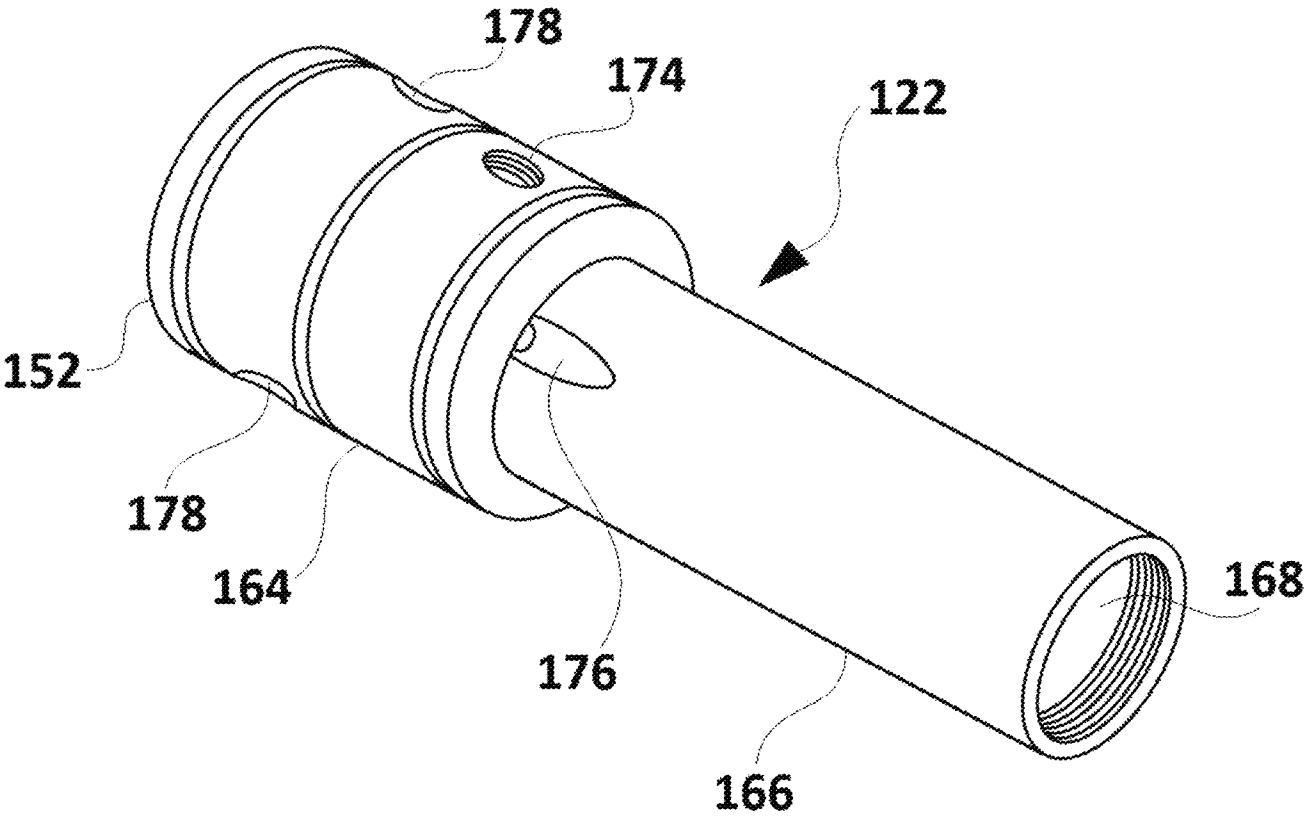
FIGS. 3A-3C illustrate various views of a shaft with flow channels which is deployed in the fluid-driven multi-mode vibration tool.
Figure 3B:
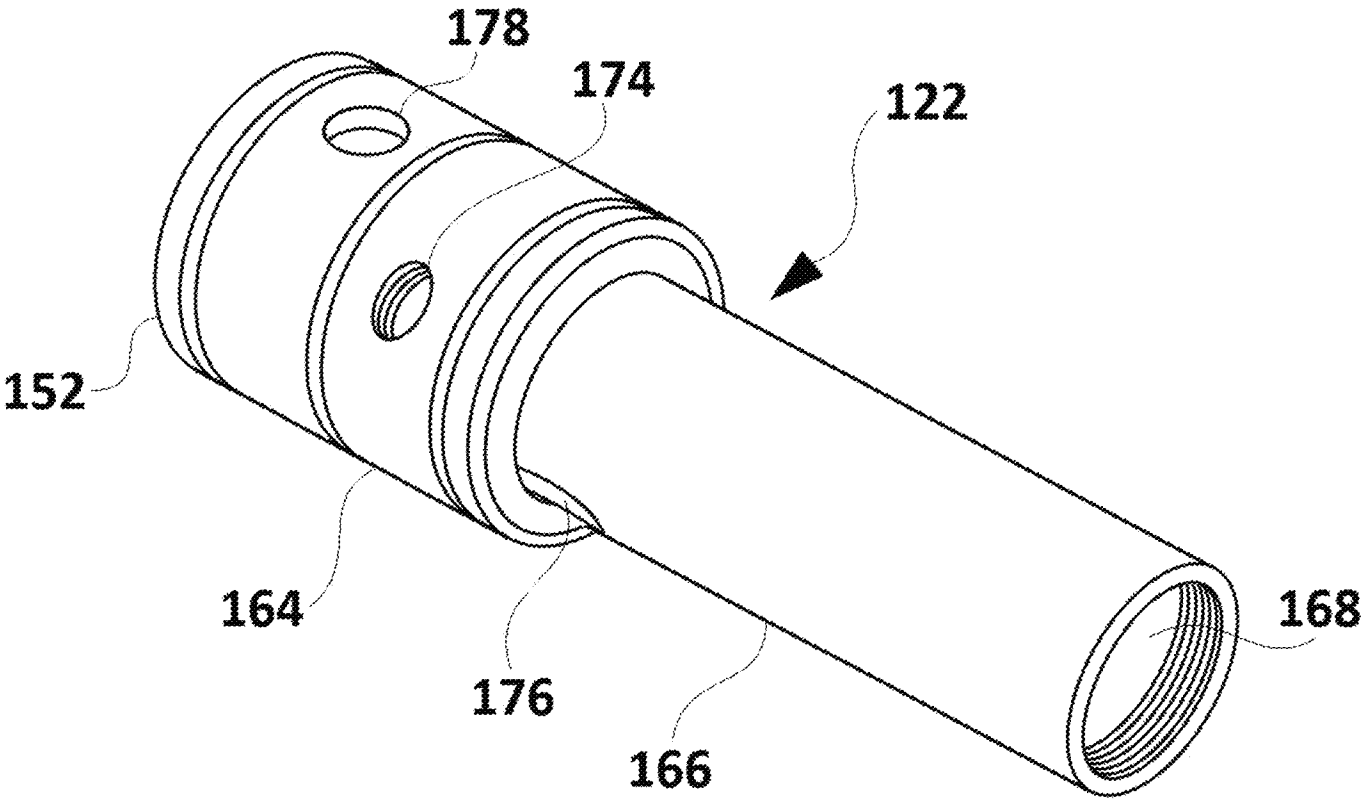
Figure 3C:
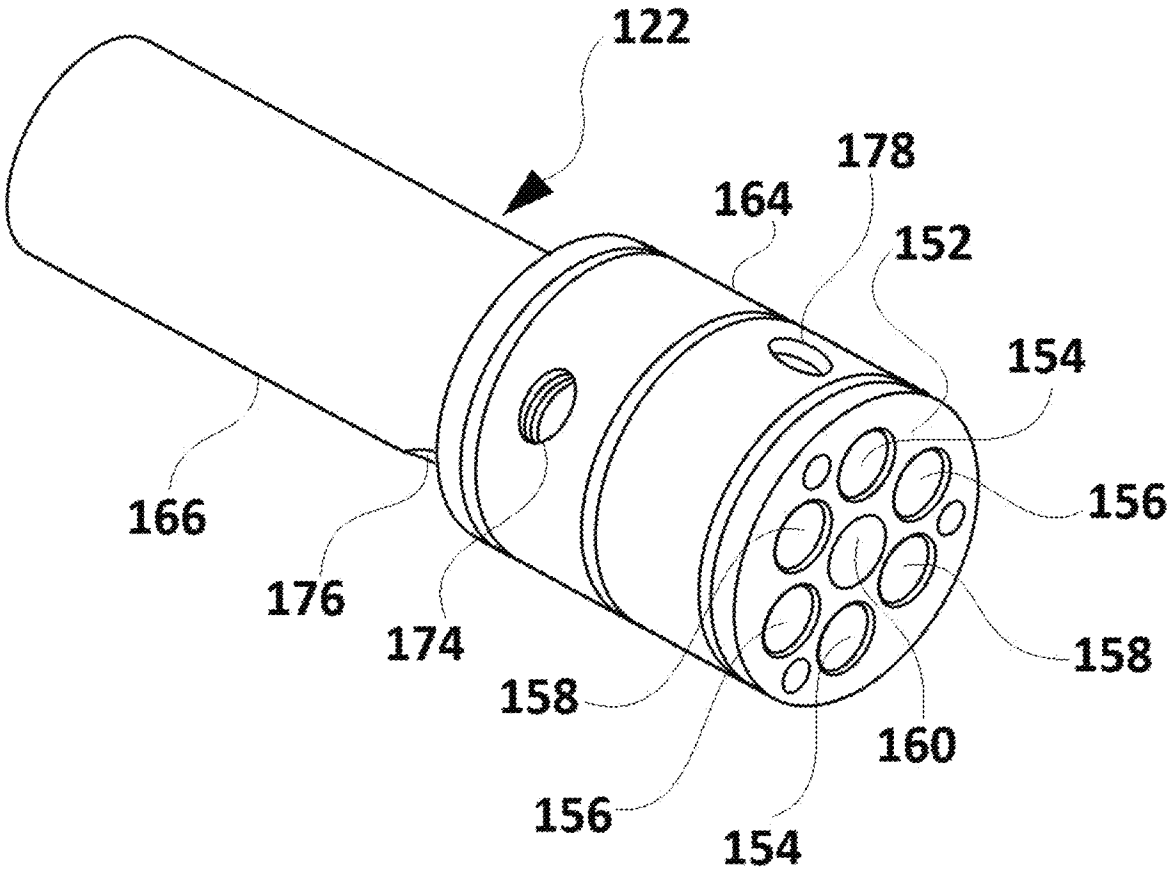
Figure 4B:
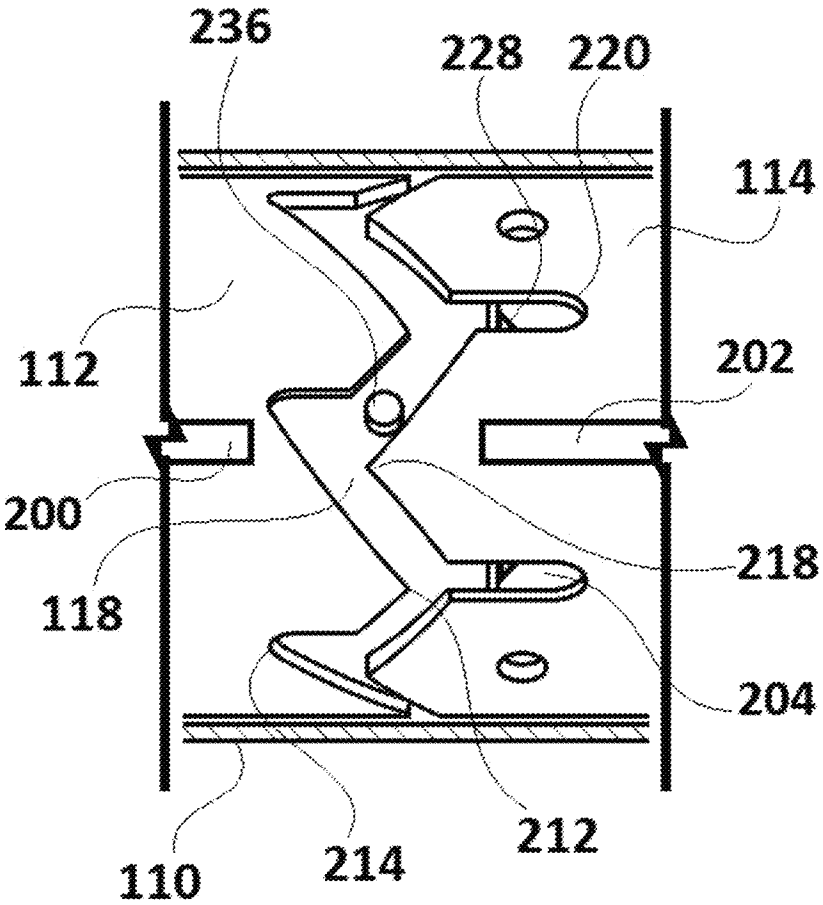
FIGS. 4A-4D illustrate rotation of the slot piston (when subjected to high pressure fluid flow through the tool) as the slot piston 236 is guided to move along the edges of the ratchet rings.
Figure 4A:
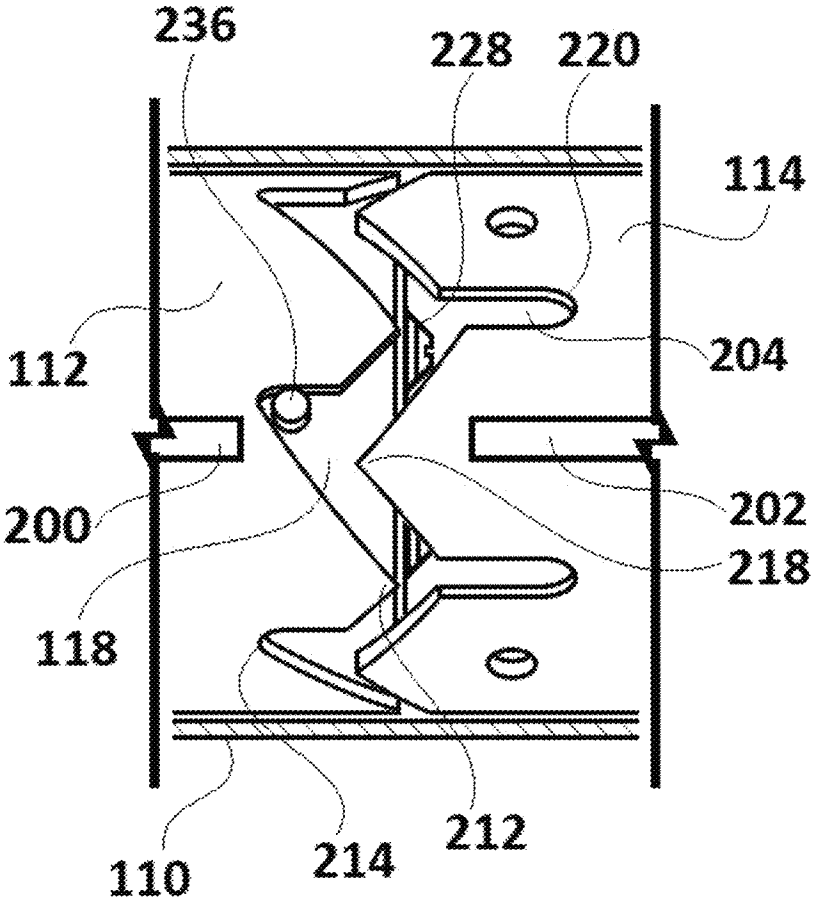
Figure 4D:
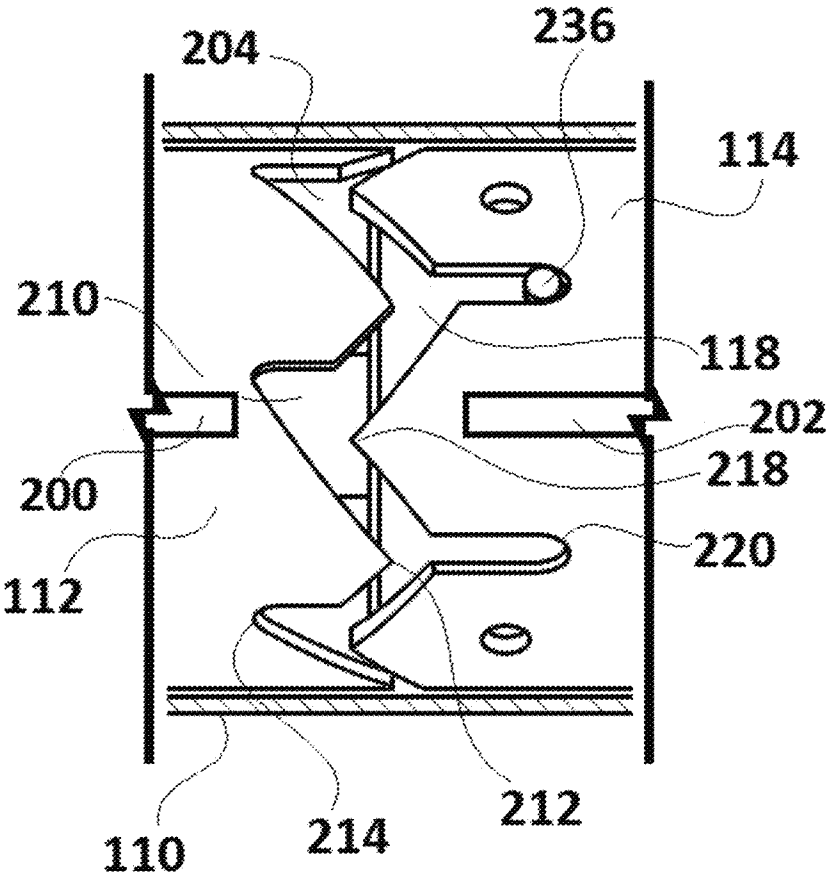
Figure 4C:
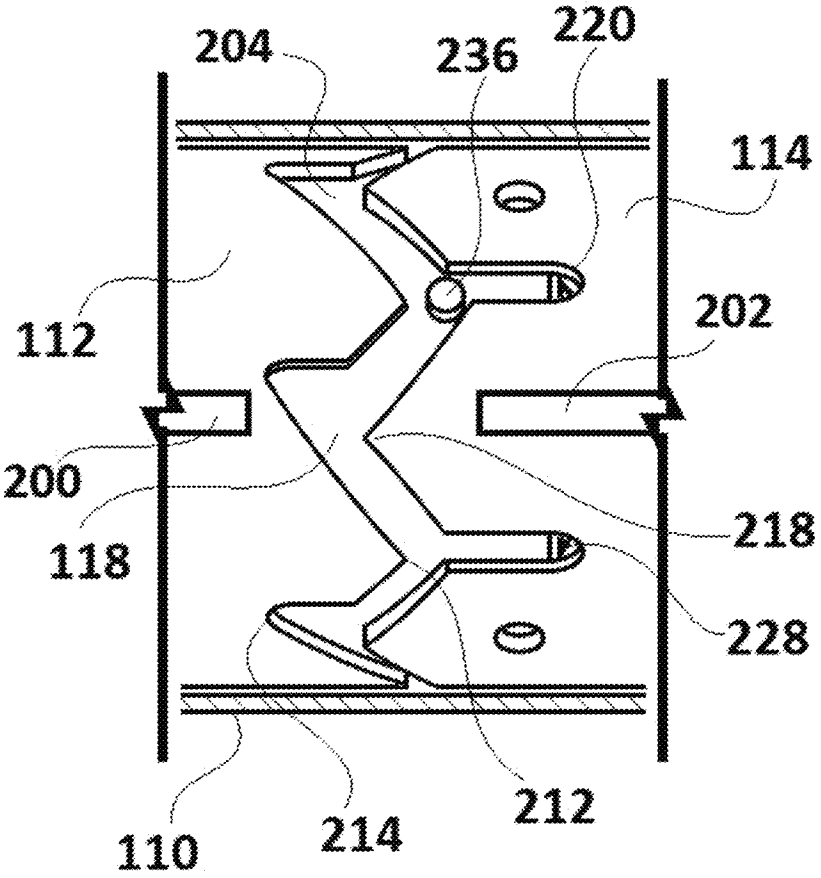

As seen in FIG. 3A-3C, shaft 122 includes a widened upper cylindrical region 164 having a flare 148 at its lower edge, and a narrower lower cylindrical region 166. The lower cylindrical region 166 includes a longitudinal central bore 168 which does not extend through the upper end of shaft 122.

Shaft 122 further includes three pairs of opposed ejection paths which extend through it, namely the first pair 154, the second pair 156 and the third pair 158. Both paths of each of these pairs (i.e. first pair 154, the second pair 156 and the third pair 158) lie opposite to each other with respect to the axis of shaft 122, and are not interconnected with each other or with any other pair's path.

The entrances of all three pairs of opposed ejection paths are similar and are symmetrically distributed on the upper end 152 of shaft 122 (see FIG. 3C) around an axial shaft well 160 in the upper cylindrical region 164.

Within shaft 122, each of the first pair of opposed ejection paths 154 bifurcates into a first sub-path 170 and a second sub-path 172. With respect to the axis of shaft 122, each of the first sub-paths 170 lie opposite to each other; and each of the second sub-paths 172 lie opposite to each other. Neither of the first sub-paths 170 are interconnected to either of the second sub-path 172. Still further, neither of the first sub-paths 170 nor the second sub-path 172 are interconnected to either of the second pair of opposed ejection paths 156 and either of the third pair of opposed ejection paths 158.

Each first sub-path 170 has an internally threaded exit 174 which lies on the upper cylindrical region 164. Both the internally threaded exits 174 (each belonging to respective first sub-path 170) lie opposite to each other in upper cylindrical region 164 (illustrated in FIGS. 2A, 6A, 7A and 8A). Each second sub-path 172 is connected to central bore 168 of shaft 122. An exit 176 of each of the second pair of opposed ejection paths 156 lies on the lower cylindrical region 166. Both the exits 176 (each belonging to respective opposed ejection paths 156) lie opposite to each other in lower cylindrical region 166 (illustrated in FIGS. 2B, 6B, 7B and 8B). An exit 178 of each of the third pair of opposed ejection paths 158 lies on the upper cylindrical region 164. Both the exits 178 (each belonging to respective opposed ejection paths 158) lie opposite to each other in upper cylindrical region 164 (illustrated in FIGS. 2C, 6C, 7C and 8C).

While each internally threaded exit 174 is aligned with one of the first pair of opposed exit ports 192 on the lower sub 104, and each exit 178 is aligned with one of the second pair of opposed exit port 194 in lower sub 104.

Each externally threaded nozzle 162 is screwed into one of the opposed exit ports 192 and into its respective underlying internally threaded exit 174. For proper functioning of the tool 100, varying lengths of each externally threaded nozzle 162 are screwed into the respective internally threaded exit 174. Each nozzle 162 extends into one of the opposed exit ports 192 (with some of its length also in the respective underlying internally threaded exit 174) maintains the alignment between the flow channels and the exit ports.

The central bore 168 also contains a flapper valve 124 which permits a downward flow of fluid through itself (and hence the central bore 168) when the fluid pressure is above a preset threshold sufficient to push open valve flap 180. In a state of rest (i.e. when no fluid flows through the tool 100, or there is no pressure on the flapper valve 124), the valve flap 180 remains pressed against the entrance of flapper valve 124 (by a resistive spring 182), and hence fluid flow path through the flapper valve 124 (and through the central bore 168) remains blocked.

When the fluid pressure at the entrance of the flapper valve 124 exceeds a threshold sufficient to overcome the resistive force of spring 182, valve flap 180 opens. To minimize any leakage of fluid which may flow through central bore 168, but through the exterior of the flapper valve 124, a head cap 184 is installed at the upper end of the flapper valve 124. An O-ring 186 installed on the head cap 184 provides a leakproof plug against the inner walls of the central bore 168 of shaft 122.

To prevent downward displacement of the flapper valve 124 under high fluid pressure on its upper surfaces, an externally threaded retainer ring 188 is screwed into a mating internally threaded lower end 190 of shaft 122.

Slot piston 118 includes an internally threaded extended center 210 on its upper end and a central piston well 216 on its lower end. The internally threaded extended center 210 and the central piston well 216 lie on the axis of the slot piston 118 but are not interconnected. The slot piston 118 further includes six flow paths extending through it, which are divided into three pairs of flow paths, namely, a first pair of flow paths 222, a second pair of flow paths 224 and a third pair of flow paths 226. All six flow paths are distributed symmetrically around the central piston well 216 such that each flow path lies exactly opposite to its corresponding flow path in the pair. Exits of all three pairs of flow paths (i.e. first pair 222, second pair 224 and third pair of 226) are internally threaded. Further, the exits of the second pair of flow paths 224 and the third pair of flow paths 226 are blocked by screwing in a seal 228 in each. All four seals 228 are made of a screw 230 having an annular sealing rubber ring 232 tightly covering a portion of thread towards the screw head. Once seals 228 are screwed into their respective exits, each of the two pairs of flow paths (i.e. second pair 224 and third pair 226) are blocked. In position in the respective exits, a portion of each seal 228 extends downwardly from the exits of the flow path it blocks.

It is to be noted instead of having the exits first pair of flow paths 222 unblocked, they could be blocked and another of the second or third pair of flow paths would be open. The open and blocked pairs can be varied, and are determined by how they direct flow.

The dimensions and profile of the extended portion of each seal 228 (as illustrated in cross-sections of tool 100) is kept such that when the lower end of the slot piston 118 is pressed against the shaft 122 and when exits of each of the six flow paths collinearly align with entrances of one of the six opposed ejection paths (i.e. either from the first pair 154 or the second pair 156 or the third pair 158), and the extended portion of each seal 228 blocks entrance of its corresponding one of the six opposed ejection paths. To provide a better sealing, the entrance of each opposed ejection paths (i.e. first pair 154, second pair 156 and third pair 158) is widened (as illustrated in FIG. 3C and in FIGS. 2A-2C, and 6A to 8C) in a manner such that it provides a perfect fitting seat for the extended portion of annular rubber ring 232.

Preferably, the diameters exits of each of the first pair of flow paths 222, the second pair of flow paths 224, and the third pair of flow paths 226 matches with the diameter of entrances of each of the opposed ejection paths (i.e. the first pair 154, the second pair 156 and the third pair 158).

On its external surface, around its circumference, the slot piston 118 further includes four protrusions, i.e., symmetrically distributed guiding pins 236 which extend transverse to the axis of slot piston 118.

Regarding the ratchet assembly, ratchet sleeve 110 is a tubular structure including two longitudinal collinear cuts (shown as upper cut 196 and lower cut 198) extending over some of its length.

Both the upper ratchet ring 112 and the lower ratchet ring 114 have an irregular edge with peaks and valleys. As shown in FIGS. 1, 4A-4D and 5A-5D, an irregular edge of the upper ratchet ring 112 includes peaks 212 and valleys 214. Similarly, an irregular edge of the lower ratchet ring 114 includes peaks 218 and valleys 220. The opposite edge of the lower ratchet ring 114 includes three resting legs 208.

The slot piston assembly is prepared by screwing an externally threaded lower end of stabilizing rod 116 into the internally threaded extended center 210 on the upper side of slot piston 118. The lower ratchet ring 114 is oriented as shown in the figures and inserted into ratchet sleeve 110 from its lower end 242 by inserting a longitudinal lower fixture key 202 (lying on the outer surface of the lower ratchet ring 114) into lower cut 198 of ratchet sleeve 110. Thereafter, slot piston 118 is inserted into ratchet sleeve 110 from its upper end 240 (keeping the attached stabilizing rod 116 facing away from the ratchet sleeve 110) until the guiding pins 236 of the slot piston 118 settle in the valleys 220 of the lower ratchet ring 114. Finally, with its irregular edge of the facing towards the ratchet sleeve 110, the upper ratchet ring 112 is inserted into the ratchet sleeve 110 from the upper end 240 by inserting a longitudinal upper fixture key 200 (lying on the outer surface of the upper ratchet ring 112) into the upper cut 196 of the ratchet sleeve 110. Within ratchet sleeve 110, the upper ratchet ring 112 and the lower ratchet ring 114 are positioned in a manner such that their respective irregular edges with peaks and valleys face each other and are separated by a gap, namely, a mating region 204 (illustrated in cross-sections of tool 100 and in FIGS. 4A to 5D). The guiding pins 236 of the slot piston 118 are placed within the mating region 204, and confined to move only within the mating region 204.

For assembling the tool 100, firstly, flapper valve 124 (with the head cap 184 on it) is pushed into the bore 168 of the shaft 122. In the next step, the retainer ring 188 is screwed into the lower end of bore 168. Thereafter, the shaft 122 is inserted into the bore 142 of the lower sub 104 (by inserting the lower cylindrical region 166 into bore 142 from the upper end 132 of the lower sub 104) in a manner such that the flare 148 rests against the annular restriction 150 (see cross-section figures of the tool 100). In the next step, a first spring seat 234 and then one end of spring 120 is inserted into shaft well 160. The prepared ratchet assembly (as described above) is then placed above the upper end 152 of shaft 122 in a manner such that a second spring seat 248 and then the other end of the spring 120 is inserted into the central piston well 216 of the slot piston 118. The resistance of the spring 120 would push the slot piston 118 outwards from the ratchet assembly, but since any displacement of guiding pins 236 is confined within the mating region 204 only, the slot piston 118 remains within the ratchet assembly. Finally, the lower end 132 of upper sub 102 (having the centralizer 108 and the tubular cup 106 installed as explained), is screwed into the upper end 132 of the lower sub in a manner such that the upper end 244 of the stabilizing rod 116 gets placed within the central channel 144 of the centralizer 108, and still further, the ratchet sleeve 110, the upper ratchet ring 112 and the lower ratchet ring 114 lie locked between lower end 130 of the upper sub 102 and the upper end 152 of shaft 122. So, the upper end 206 of the upper ratchet ring 112 and the upper end 240 of the ratchet sleeve 110 lie adjacent to the upper sub 102, and the lower end 242 of the ratchet sleeve 110 and the lower end of the lower ratchet ring 114, through its resting legs 208, lies adjacent to the upper end 152 of shaft 122.

Figure 9:
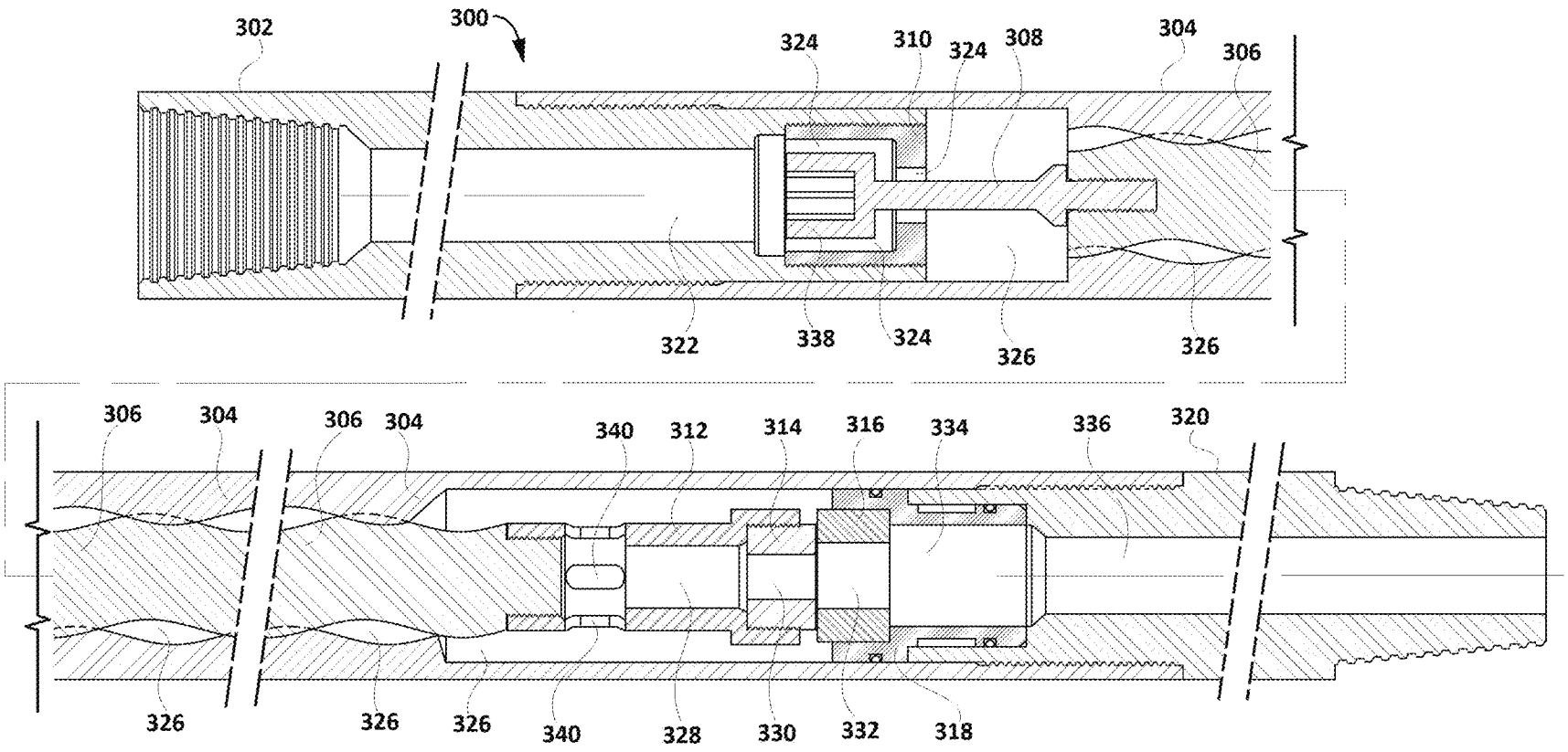
FIG. 9 illustrates cross-sectional view of an embodiment of downhole motor being attachable to the first embodiment of the fluid-driven multi-mode vibration tool.

Based on the mode of operation of the tool 100 (as explained below), the downhole motor 300 when attached to the end 246 of the lower sub 104, generates the vibrations of different amplitudes. As illustrated in FIG. 9, the motor 300 includes an upper motor sub 302, a stator 304, a rotor 306, a rotor rod 308, a rod seat 310, a rotor flow cylinder 312, an upper flow cylinder 314, a lower flow cylinder 316, a retainer 318 and a lower motor sub 320.

While the upper end of the stator 304 screws over and connects with the lower end of the upper motor sub 302, the lower end of the stator 304 screws over and connects with the upper end of the lower motor sub 320. The rod seat 310 (having the rotor rod 308 extending through it) is screwed into the lower end of the upper motor sub 302. A lower end of the rotor rod 308 is screwed into the upper end of the rotor 306 which extends into the stator 304. The rotor 306, having a helical outer surface, is surrounded by a mating helical internal surface portion of the stator 304 in a manner such that rotation of the rotor 306 within the stator 304 provides a helical fluid flow path around the outer surface of the rotor 306. The lower end of the rotor 306 is screwed into upper end of the rotor flow cylinder 312, and the lower end of the rotor flow cylinder 312 is screwed over the upper flow cylinder 314. The lower flow cylinder 316 is placed between the upper flow cylinder 314 and the retainer 318 which fits snugly in the upper end of the lower motor sub 320.

Figure 10B:
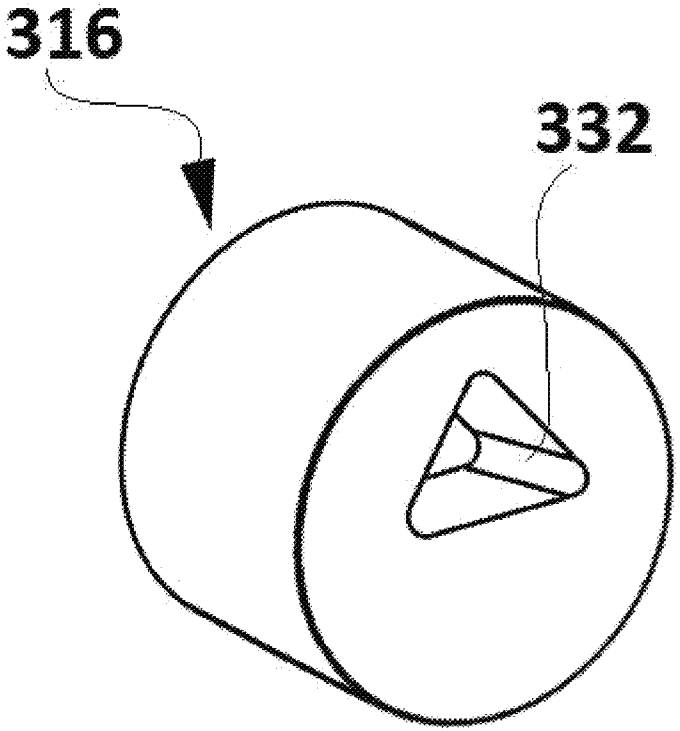
FIGS. 10A and 10B illustrate perspective views of the upper flow cylinder and the lower flow cylinder deployed in the downhole motor of FIG. 9.
Figure 10A:
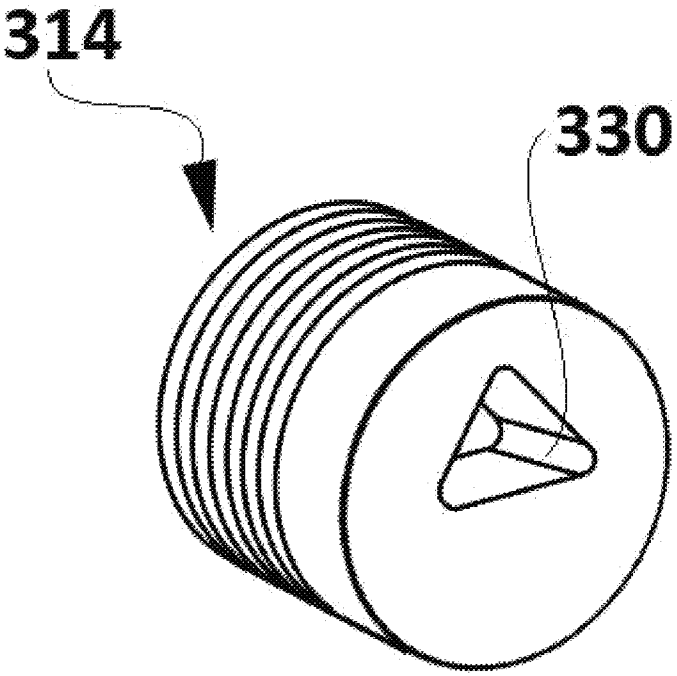

The downhole motor 300 further includes central bores 322, 324, 326, 328, 330, 332, 334 and 336 (belonging to the upper motor sub 302, the rod seat 310, the stator 304, the rotor flow cylinder 312, the upper flow cylinder 314, the lower flow cylinder 316, the retainer 318 and the lower motor sub 320 respectively). All bores, except bores 330 and 332 are axially aligned. As illustrated in FIGS. 10A and 10B, bores 330 and 332 lie asymmetrically around axis of the upper flow cylinder 314 and the lower flow cylinder 316, respectively.

During operation, when the upper motor sub 302 of the motor 300 is connected to the lower sub 104 of tool 100, pressurized fluid ejected from tool 100 enters into the motor 300 (through the upper motor sub 302), and flows through the bore 326 causing the helically shaped rotor 306 to rotate. As the rotor rotates, pressurized fluid flows downwards through the helical flow path formed between the rotor 306 and the stator 308 and enters the rotor flow cylinder 312 through apertures 340. Thereafter, it flows into the bore 330 of the upper flow cylinder 314. However, since the rotor 306 is in a state of rotation (and causes upper flow cylinder 314 to rotate too), and since bores 330 and 332 lie asymmetrically around axis of the upper flow cylinder 314 and the lower flow cylinder 316 respectively, fluid flows into bore 332 in variable quantities (based on alignment status of bores 330 and 332 during rotation of the rotor 306). Variation of fluid flow results in generation of vibrations from downhole motor 300. Finally, after flowing through the bore 332, pressurized fluid flows through bore 334 and bore 336 and gets ejected from the lower end of the lower motor sub 320.

The rotor rod 308 (an upper bulging portion 338 of which is included within a mating portion of bore 324) helps minimizing axial deviation of the rotor 306 during rotation. Instead of or in addition to using a downhole motor to generate shock waves, one could use a dedicated shock wave generating tool, similar, for example, to that shown in U.S. patent Ser. No. 11/745,324B2 (incorporated by reference).

The operation of the assembled fluid-driven multi-mode vibration tool 100, when deployed in a coiled tubing of a well-bore, will now be explained with the help of accompanying figures.

Figure 2A:
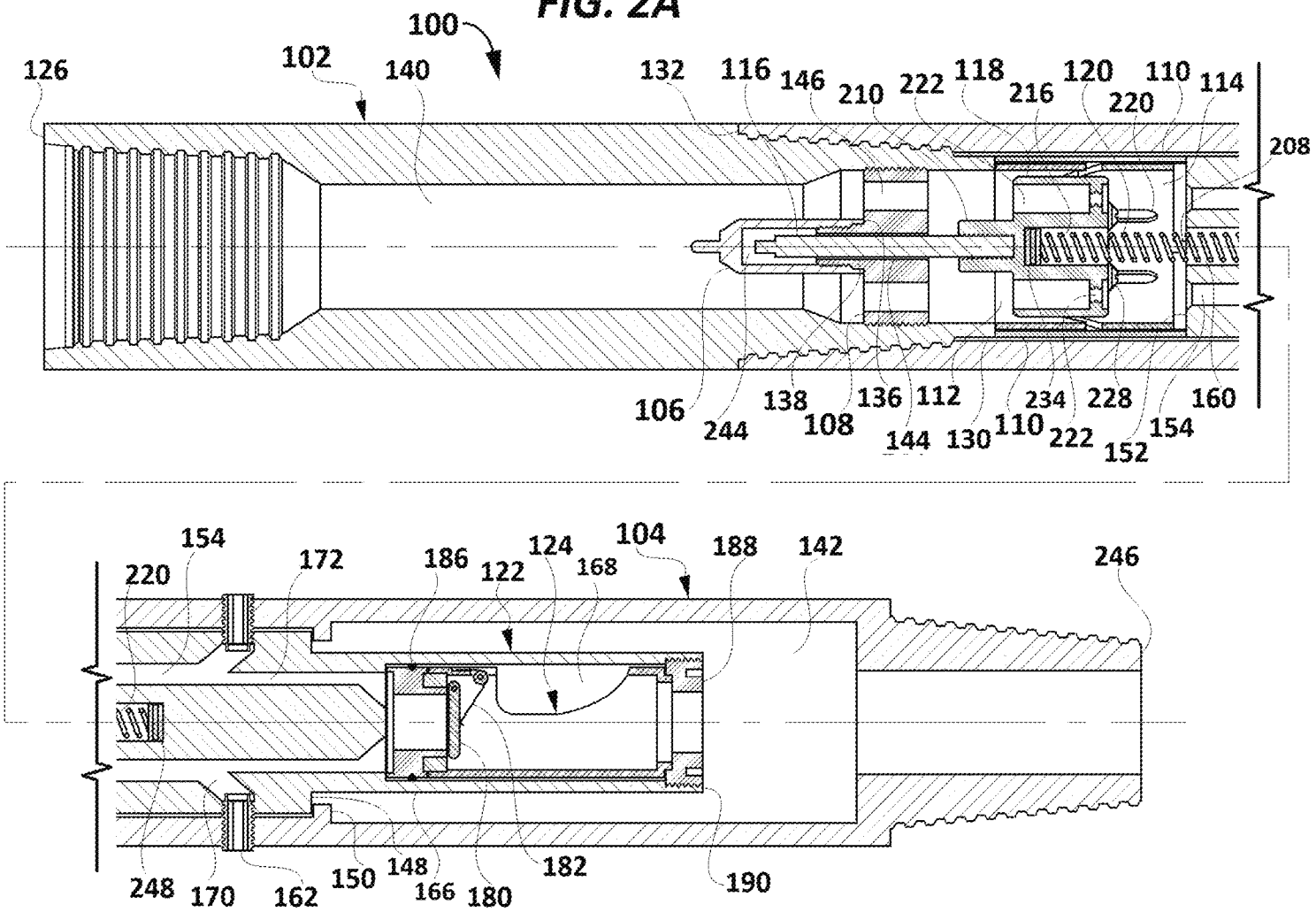
FIG. 2A is a first longitudinal cross-sectional view of the assembled first embodiment of the fluid-driven multi-mode vibration tool, positioned at rest prior to fluid flow.
Figure 2B:
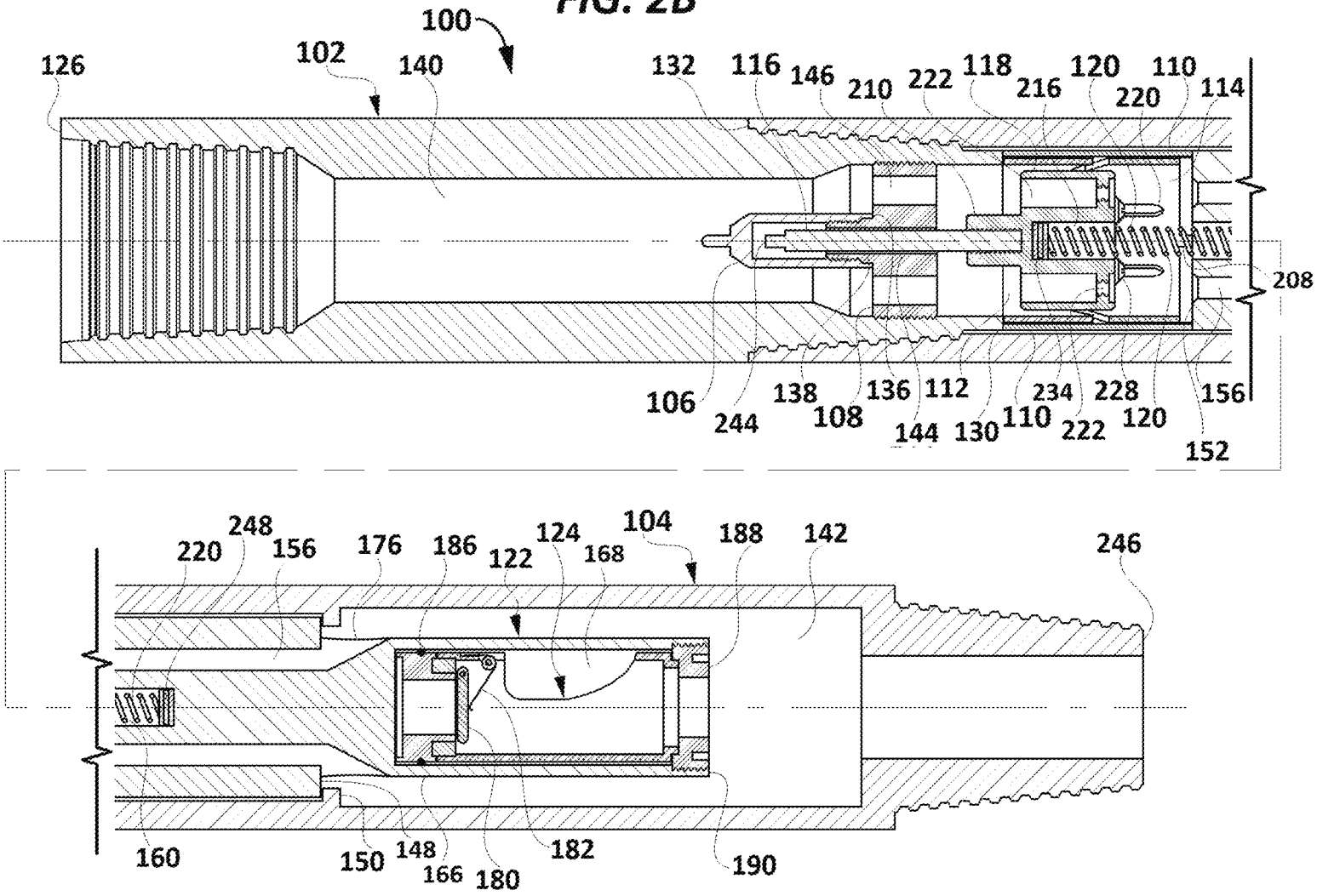
FIG. 2B illustrates a second longitudinal cross-section, where this second cutting plane is at 120 degrees from the cutting plane of the first longitudinal cross-section of FIG. 2A, where the same tool is in the same position, at rest prior to fluid flow.
Figure 2C:
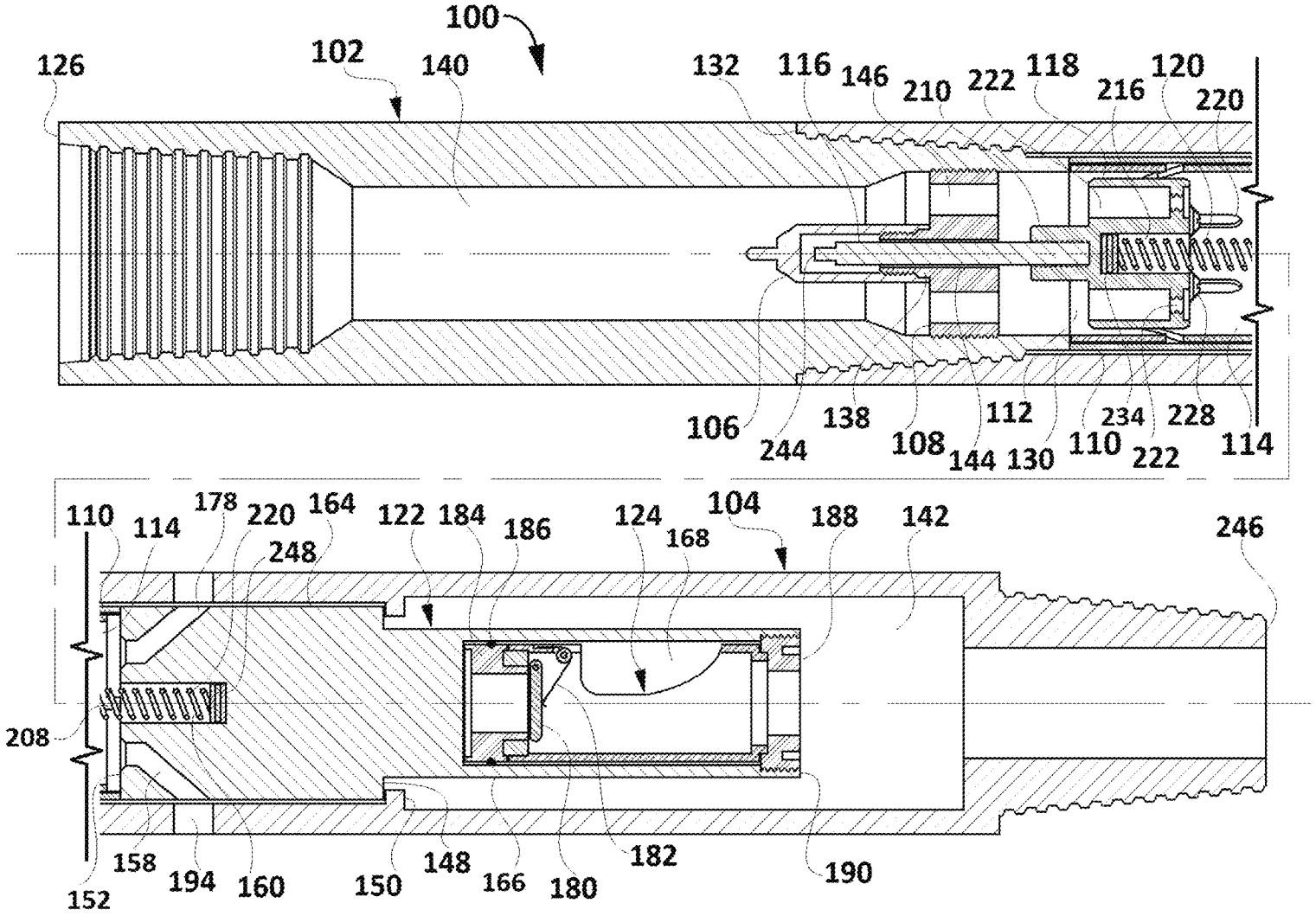
FIG. 2C illustrates a third longitudinal cross-section, where this third cutting plane is at 240 degrees from the cutting plane of the first longitudinal cross-section of FIG. 2A, where the same tool is in the same position, at rest prior to fluid flow.

FIGS. 2A to 2C illustrate the state of tool 100 with no fluid flows through it. In this state, the spring lies 120 in expanded state and the guiding pins 236 (illustrated in FIG. 4A) are pressed against a valley 214 of the upper ratchet ring 112 (note that in FIGS. 4A-4D, only the ratchet sleeve 110 is shown in cross-section).

When pressurized fluid flows into upper sub 102 (from upper end 126), it travels through central bore 140 and then through six parallel flow channels 146 of centralizer 108, from where it is delivered into the ratchet assembly to slot piston 118. As four out of six flow paths through slot piston 118 are blocked (as mentioned above) a downward force is exerted on slot piston 118. As a result, the guiding pins 236 are displaced downwards until they contact the slant edge between the peak 218 and the valley 220 of lower ratchet ring 114 (see FIG. 4B). However, since the guiding pins 236 are confined to move only within the mating region 204, the exerted fluid pressure forces them to slide along the slant edge causing slot piston 118 to rotate, until they enter the next valley 220 of lower ratchet ring 114 (see FIGS. 4C and 4D). Movement of guiding pins 236 from a valley 214 of the upper ratchet ring 112 into a next valley 220 of the lower ratchet ring 114 results in longitudinal displacement and rotation of slot piston 118 to its next position.

Longitudinal displacement the slot piston 118 also results in compression of spring 120 and causes the lower end of the slot piston 118 to contact the upper end 152 of shaft 122. In the assembled tool 100, since each path among the three pairs of flow paths (i.e first pair of flow paths 222, second pair of flow paths 224 and the third pair 226) are collinearly aligned with one of the six opposed ejection paths (i.e. either from first pair 154, second pair 156 or third pair 158), and as explained above, this results in successive sealing of the entrance to two pairs of the opposed ejection paths.

Figure 6A:
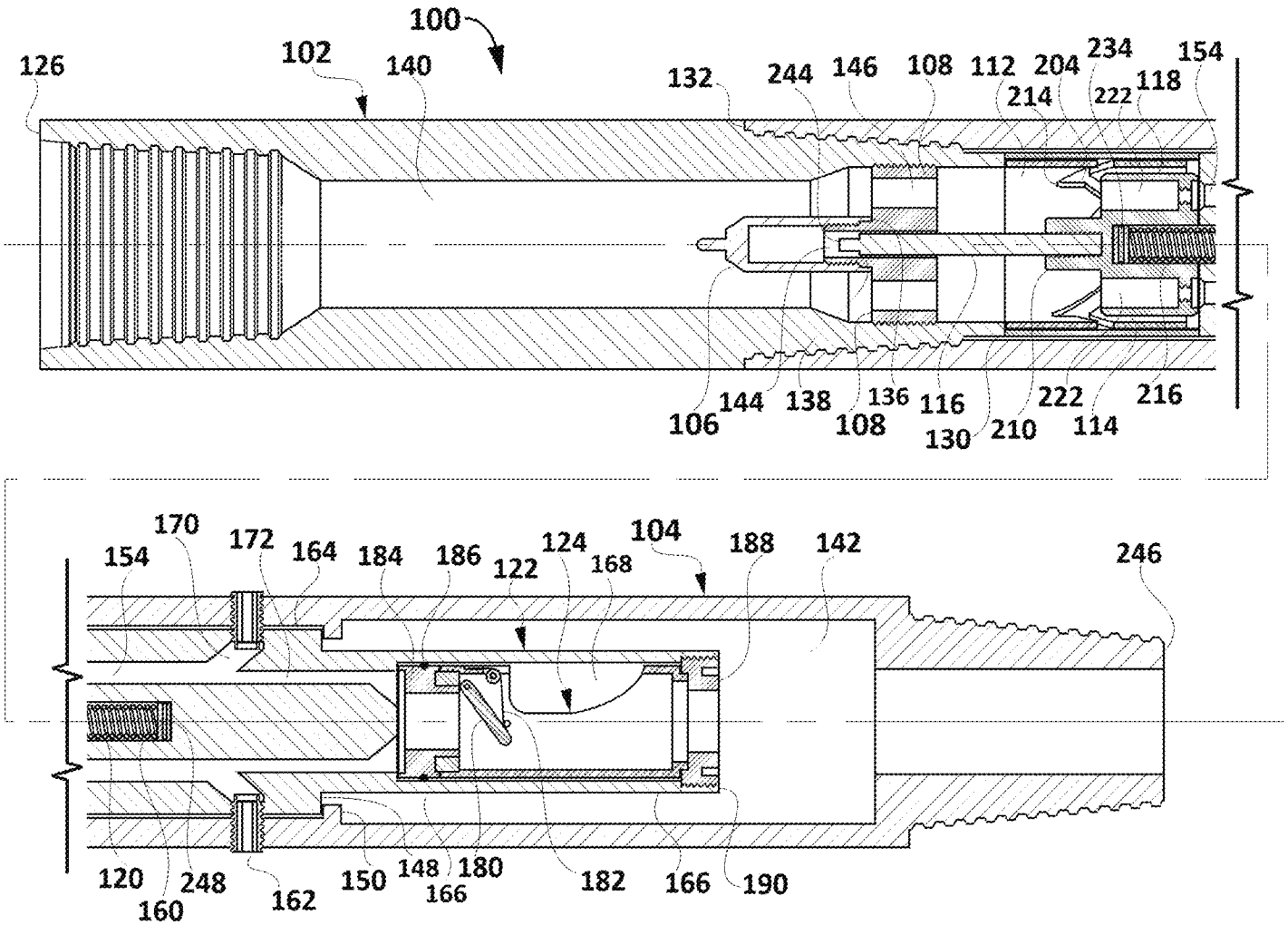
FIGS. 6A-6C illustrate different longitudinal cross-sectional views of the assembled first embodiment of the fluid-driven multi-mode vibration tool subjected to pressurized fluid flow and operating in a 'low' amplitude mode.
Figure 6B:
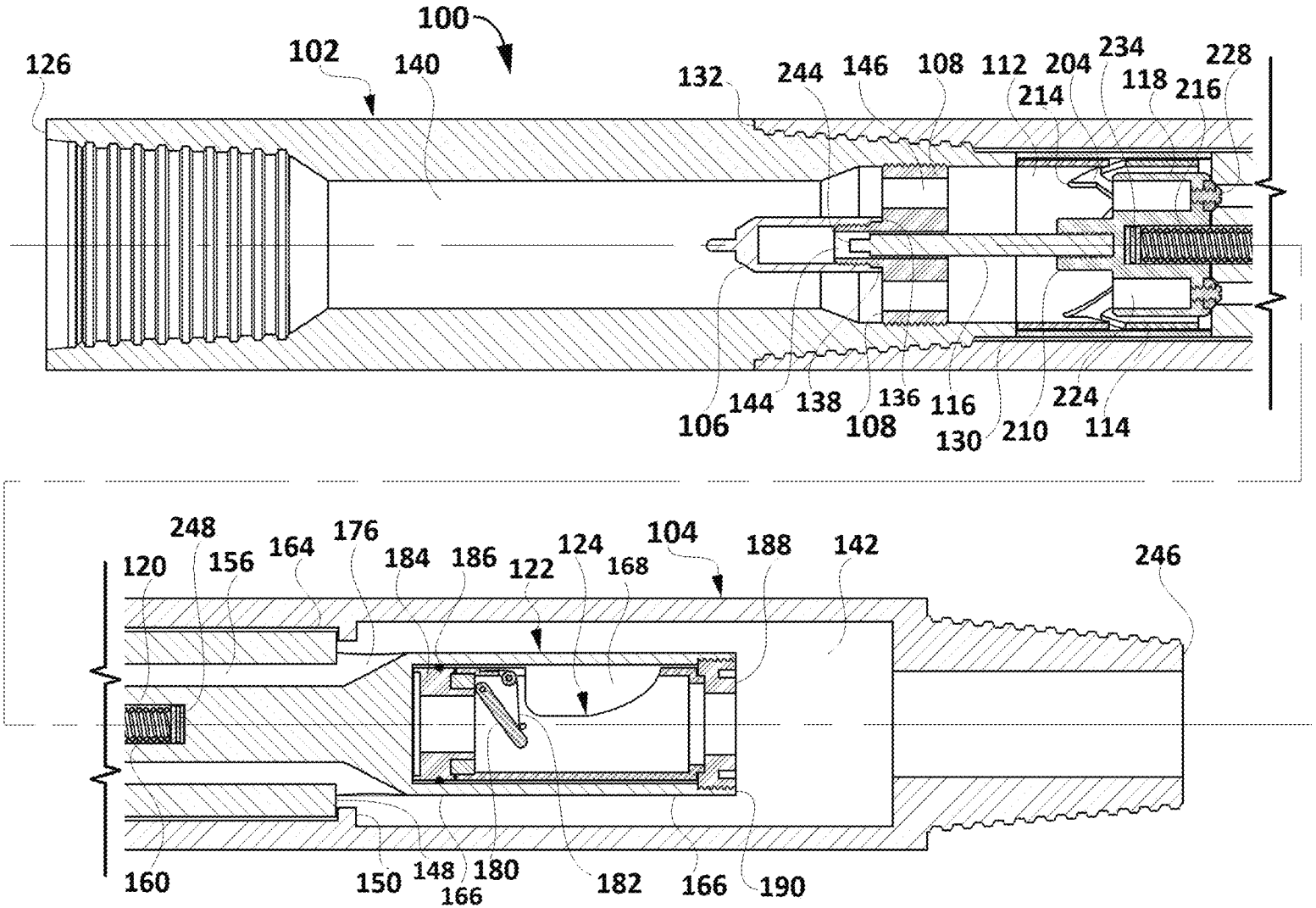
Figure 6C:
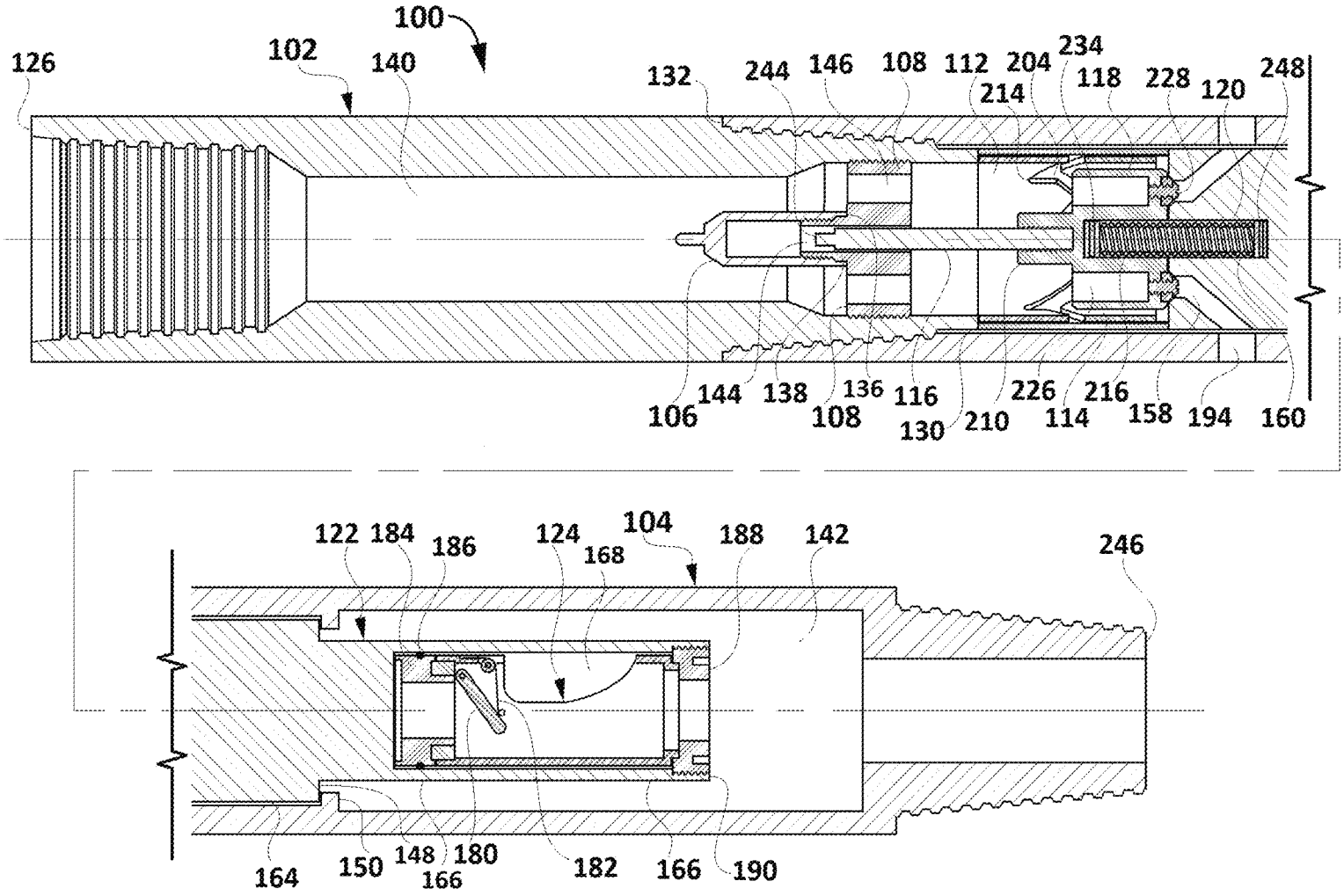

Still further, since the pressurized fluid gets delivered into shaft 122 only through the first pair of flow paths 222 of slot piston 118 (the others being blocked), only one corresponding pair of opposed ejection paths of the shaft 122 receive fluid inflow. For example, as illustrated in FIGS. 6A-6C, since only the first pair of opposed ejection paths 154 is aligned with the first pair of flow paths 222, only the first pair of opposed ejection paths 154 receives fluid inflow. Note that since the entrances to the second pair 156 and the third pair 158 of opposed ejection paths are blocked by seals 228 (second pair of flow paths 224 and third pair of flow paths 226) they do not receive any fluid inflow. Cross-sections of the tool 100 during fluid flow through the first pair of opposed ejection paths 154 are illustrated in FIGS. 6A-6C.

After flowing through the first pair of opposed ejection paths 154 the pressurized fluid enters into respective first sub-paths 170 and respective second sub-path 172. After travelling through each first sub-path 170 the pressurized fluid gets ejected from the corresponding nozzle 162, which is screwed into both the corresponding internally threaded exit 174 and the corresponding opposed exit port 192. After flowing through the respective second sub-path 172, the pressurized fluid exerts pressure on the flap 180 of the flapper valve 124. If the fluid pressure is above a threshold to overcome resistance of the spring 182, the flap 180 is pushed open and the fluid enters through the flapper valve 124 and gets ejected out into the bore 142 of the lower sub 104. Finally, the fluid flows out of the tool 100 through the lower end 246 of the lower sub 104. This is the 'low' intensity mode of operation of the tool 100.

After leaving tool 100, pressurized fluid flows into the downhole motor 300 attached to the lower sub 104 of the tool 100. Downhole motor 300 generates shock waves and vibrations as explained above.

Flow through the first sub-paths 170 and second sub-path 172, generates only vibrations of lower amplitude, than when another pair of opposed ejection paths is unblocked and the corresponding remaining two pairs of the opposed ejection paths are blocked.

Figure 5B:
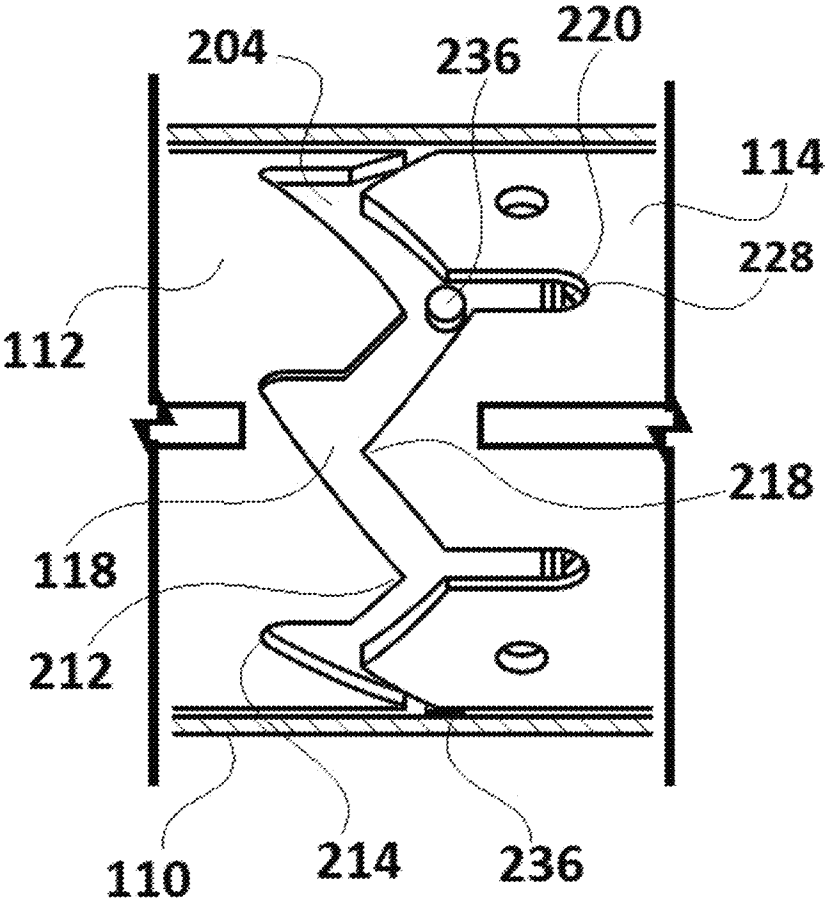
FIGS. 5A-5D illustrate rotation of slot piston after interruption of high pressure fluid flow through the tool, as the slot piston 236 has a guide moving along the edges of the ratchet rings causing the rotation.
Figure 5A:
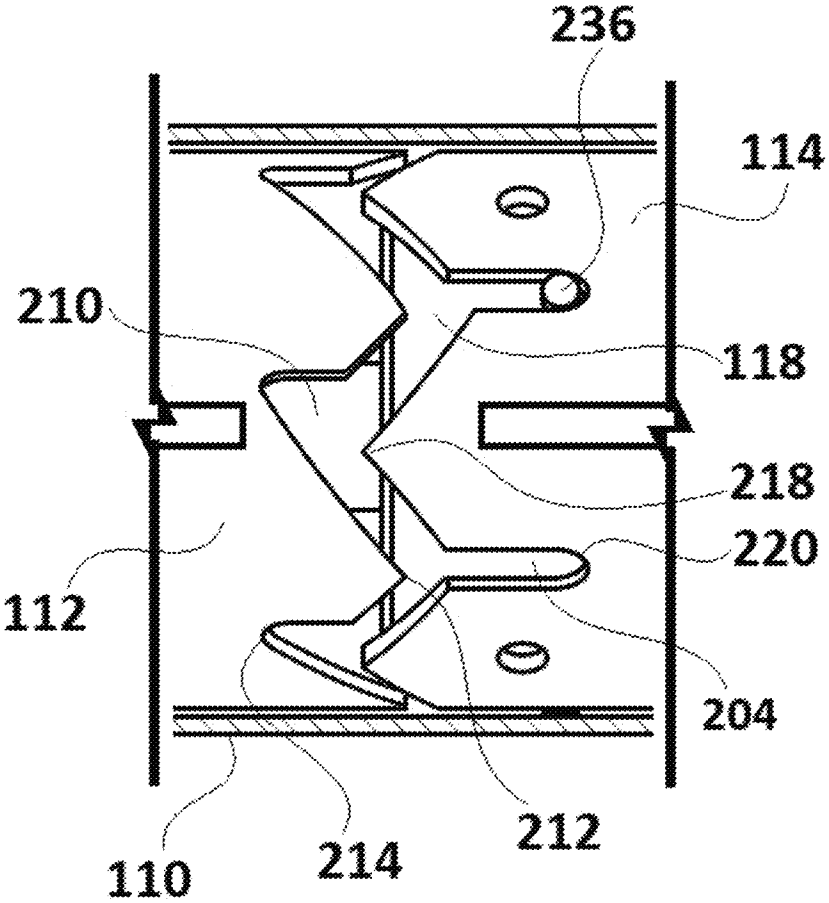
Figure 5D:
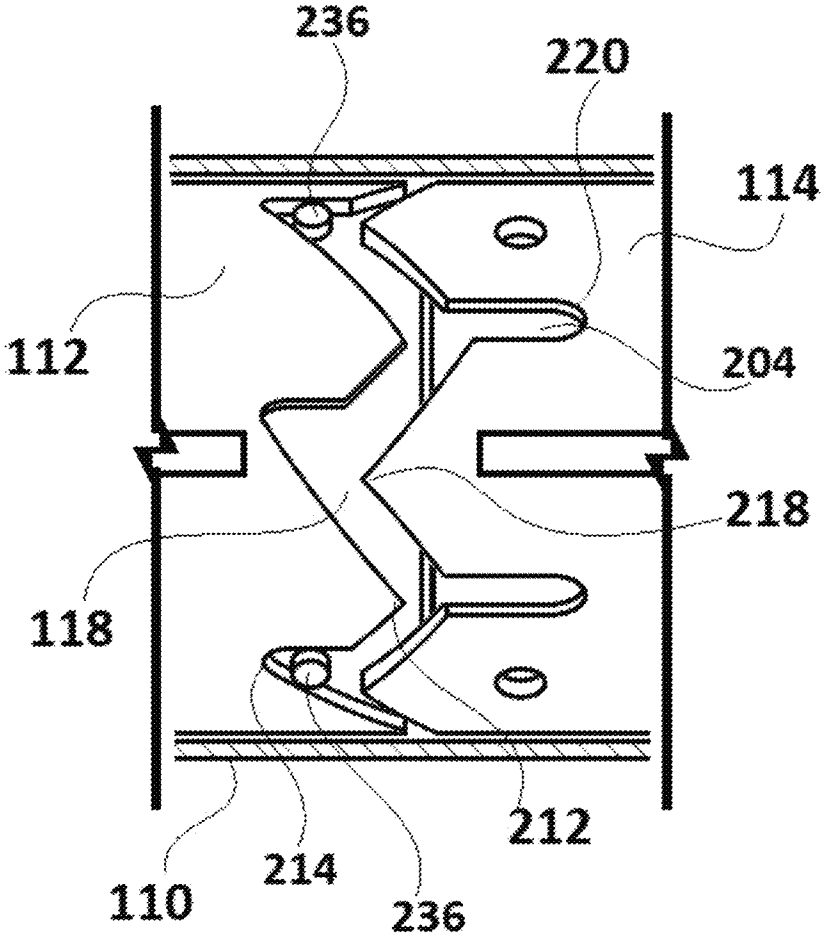
Figure 5C:
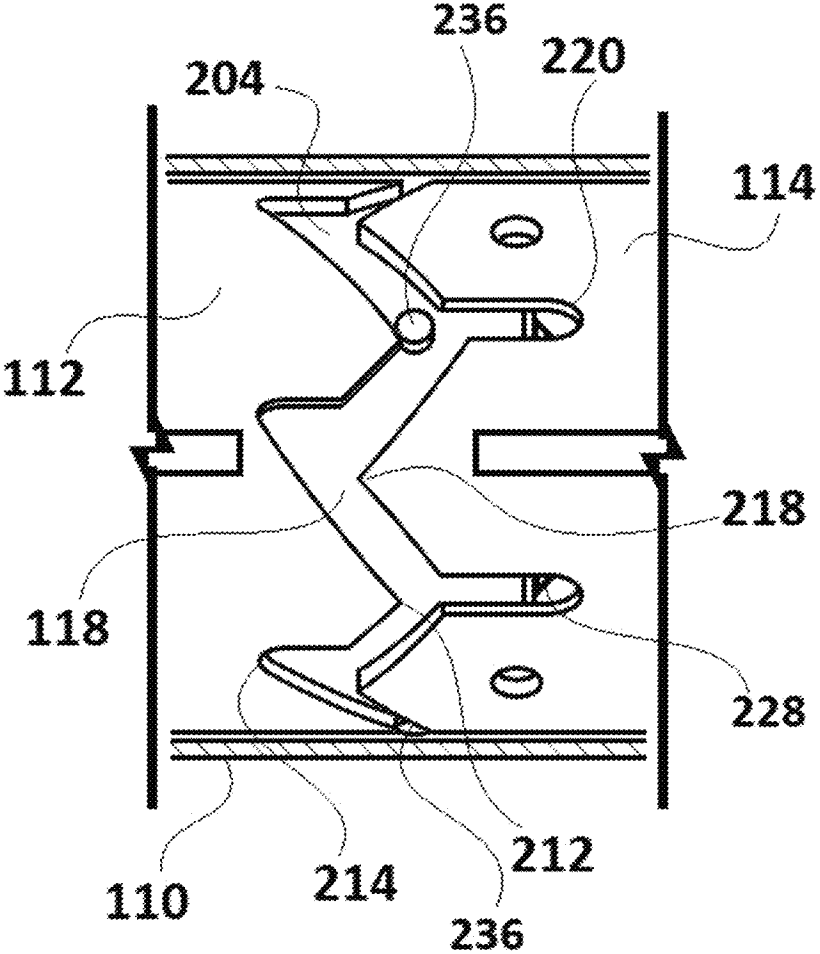

Interruption of the fluid flow releases the downward pressure on spring 120 and allows it to uncompress and move slot piston 118 upwardly. Initially guiding pins 236 are positioned as shown in FIG. 5A (note that in FIGS. 5A-5D, only the ratchet sleeve 110 is shown in cross-section). However, in response to the upward force exerted by the spring 120, the guiding pins 236 are displaced upwards to hit the slant edge between the peak 212 and the valley 214 of the upper ratchet ring 112 (see FIG. 5C). They then slide through the slant edge causing slot piston 118 to rotate, until they enter the next valley 214 of the upper ratchet ring 112 (see FIGS. 5C and 5D). Such movement of guiding pins 236 from a valley 220 of the lower ratchet ring 114 into a next valley 214 of the upper ratchet ring 112 causes upward longitudinal displacement and rotation of the slot piston 118.

Thereafter, reinstating the fluid flow again places the guiding pins 236 to the next following valley 220 of the lower ratchet ring 114, results in downward displacement of the slot piston 118 and further rotates the slot piston 118 to a next position (as explained above).

This next downward longitudinal displacement slot piston 118 again induces compression of spring 120 and causes the lower end of slot piston 118 to contact the upper end 152 of the shaft 122. Rotation of the slot piston 118 to a next position aligns the first pair of flow paths 222 of slot piston 118 (from which the fluid inflows) with the next pair of opposed ejection paths (this time, the second pair of opposed ejection paths 156), and results in blockage of the entrance of next two pairs of opposed ejection paths (this time the third pair 158 and the first pair 154) by the four extending seals 228 of the second pair of flow paths 224 and third pair of flow paths 226.

Figure 7A:
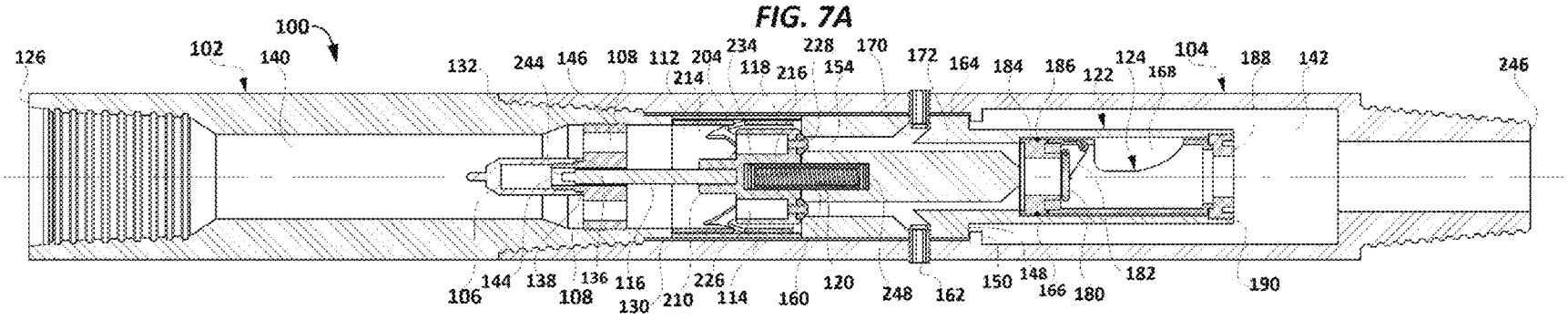
FIGS. 7A-7C illustrate cross-sectional views of the assembled first embodiment of the fluid-driven multi-mode vibration tool subject to pressurized fluid flow and operating in a 'high' amplitude mode.
Figure 7B:
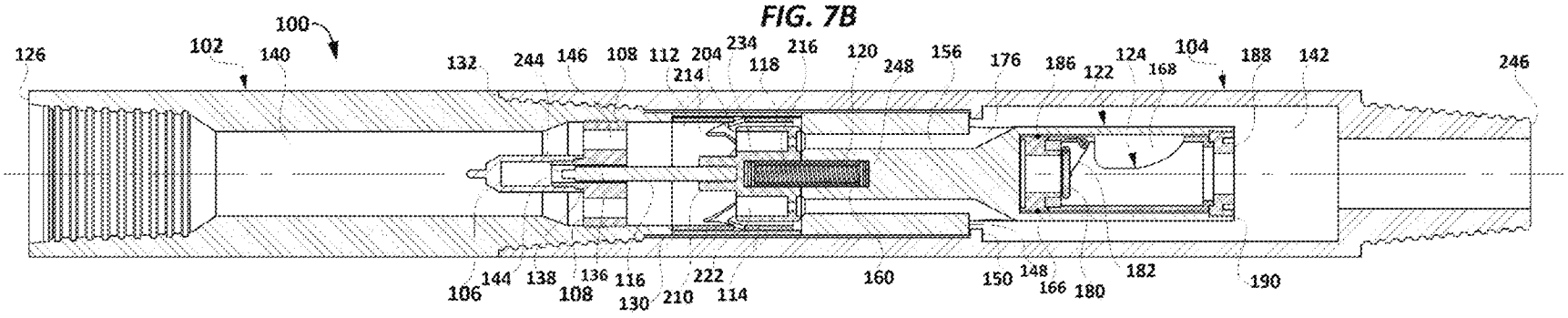
Figure 7C:
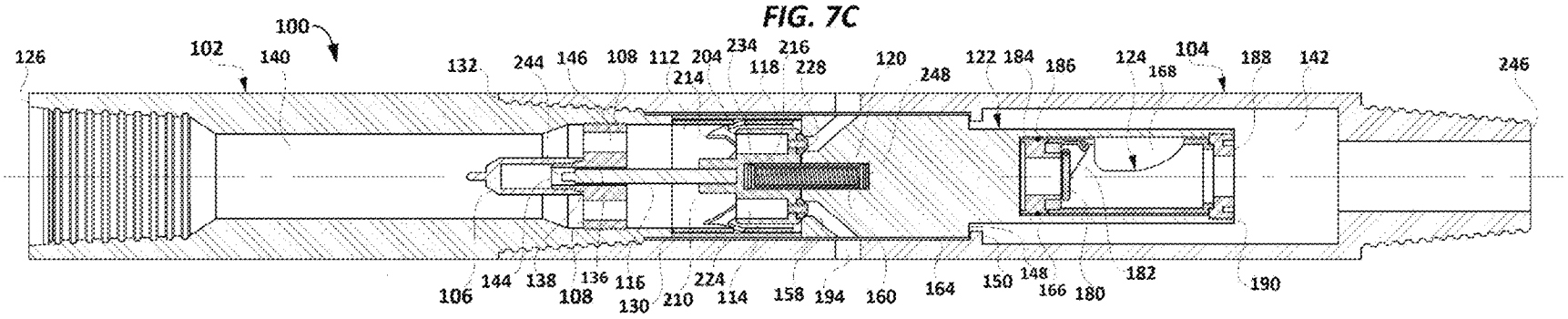

Hence, this time, only the second pair of opposed ejection paths 156 (which are aligned with the first pair of flow paths 222) receive fluid inflow. Cross-sections of the tool 100 during fluid flow through the second pair of opposed ejection paths 156 are illustrated in FIGS. 7A-7C.

After flowing through the second pair of opposed ejection paths 156 the pressurized fluid gets ejected from the corresponding exits 176 on the lower cylindrical region 166 of shaft 122, and flows into bore 142 of lower sub 104, and then out through the lower end 246 of the lower sub 104. This is the 'high' intensity mode of operation of the tool 100.

The flow through the second pair of opposed ejection paths 156 generates higher amplitude shock waves than those generated by fluid flowing through the first pair of opposed ejection paths 154.

To stop generation of all significant shock waves even while pressurized fluid flows through tool 100, the flow of pressurized fluid through is interrupted and then reinstated again. Similar to the description provided above, interruption of the fluid flow causes decompression of spring 120 and movement of guiding pins 236 from a valley 220 of the lower ratchet ring 114 into a next valley 214 of the upper ratchet ring 112, as well as longitudinal displacement and further rotation of slot piston 118

Thereafter, reinstating the fluid flow again places the guiding pins 236 to the next following valley 220 of the lower ratchet ring 114, and further rotates the slot piston 118 to a next position and again results in its downward displacement (as explained above).

Figures 8A, 8B, 8C:
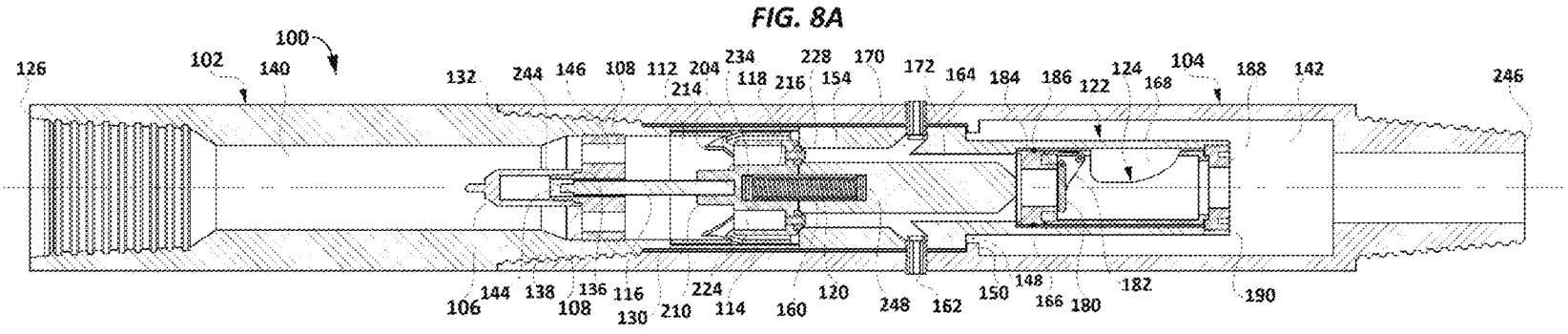
FIGS. 8A-8C illustrate cross-sectional views of the assembled first embodiment of the fluid-driven multi-mode vibration tool subject to pressurized fluid flow and operating in an 'off' mode, where the vibrations from the fluid exit at ports 194 is negligible.

Ultimately, this places the third pair of opposed ejection paths 158 in alignment with the first pair of flow paths 222, and able to receive fluid inflow; whereas the entrances to first pair 154 and second pair 156 of opposed ejection paths remain blocked by seals 228. Cross-sections of the tool 100 during fluid flow through the third pair of opposed ejection paths 158 are illustrated in FIGS. 8A-8C.

After flowing through the third pair of opposed ejection paths 158 the pressurized fluid flows out from the corresponding exits 178 on the upper cylindrical region 164 of shaft 122, then through the second pair of opposed exit ports 194 (which are aligned with corresponding exits 178) on the lower sub 104. This is the 'off' mode of operation of the tool 100.

Flow through the opposed ejection paths 158 and then out from the tool 100 holds the fluid at such low pressure that it only results in generation of negligible shock waves.

It is to be noted that during longitudinal displacement of the slot piston 118, a portion of the stabilizing rod 116 (along with its upper end 244) also gets displaced longitudinally. The longitudinal displacement of the upper end 244 is confined (and guided longitudinally) within the hollow longitudinal space of the tubular cup 106 (or within the longitudinal space of the central channel 144 of the centralizer 106). This guided longitudinal displacement of the stabilizing rod 116 minimizes deviations of the slot piston 118 from its longitudinal path during displacements, and results in smoother operation of tool 100.

It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A fluid-driven multi-mode vibration tool operable by interrupting and then reinstating the flow of pressurized fluid the tool, and wherein interrupting and then reinstating the flow of pressurized fluid opens different fluid ejection paths through the tool while blocking others, comprising:

a central bore of the tool housing a shaft, said shaft having at least three pairs of opposed fluid ejection paths extending through it, each of said opposed ejection paths having an entrance and an exit, and the exits of said first pair of opposed ejection paths access a first pair of opposed exit ports on circumference of the tool, the exits of said second pair of opposed ejection paths access the central bore, and the exits of said third pair of opposed ejection paths access a second pair of opposed exit ports on circumference of the tool;

a rotatable slot piston above the shaft and engaged with a ratchet assembly, said ratchet assembly mounted within the tool and having a zig zag path defining a series of peaks and valleys within the central bore;

said slot piston having one or more blocked and one or more unblocked flow paths extending through it and said slot piston being engaged with the ratchet assembly such that axial movement of the slot piston causes movement to the next peak or valley in the zig zag path; and wherein, each blocked and each unblocked flow path has an entrance and an exit, and wherein the exit of each blocked and each unblocked flow path can align with an entrance of said opposed ejection paths, and wherein the exit of each blocked flow path includes a seal which can seal the entrance to said opposed ejection paths when blocked exits of the slot piston are adjacent the shaft.

2. The fluid-driven multi-mode vibration tool of claim 1, wherein the slot piston has a series of protrusions on its circumference configured to engage the zig zag path.

3. The fluid-driven multi-mode vibration tool of claim 2, wherein said protrusions are pins.

4. The fluid-driven multi-mode vibration tool of claim 1, wherein the zig zag path is defined by the lower edge of an upper ratchet ring and the upper edge of a lower ratchet ring, said upper and lower ratchet rings fixed with respect to the central bore.

5. The fluid-driven multi-mode vibration tool of claim 1, further including a centralizer fixed above the slot piston in the central bore and having a series of channels extending through the centralizer, each channel having an entrance and an exit.

6. The fluid-driven multi-mode vibration tool of claim 5, wherein said centralizer further includes an axially extending central channel accommodating a stabilizing rod which is fixed to the center of the slot piston, said stabilizing rod extends axially into a tubular cup extending axially from the upper side of the centralizer.

7. The fluid driven multi-mode vibration tool of claim 1, wherein each path of said first pair of opposed ejection paths bifurcates into a first sub-path and a second sub-path, wherein the lower end of said first sub-paths access an inner end of a nozzle accessing the outside of the tool.

8. The fluid driven multi-mode vibration tool of claim 7, wherein each of the second sub-paths extend into an inner bore in the shaft.

9. The fluid driven multi-mode vibration tool of claim 8, wherein said inner bore further includes a flapper valve which permits flow through the shaft and to the central bore and outflow from the tool.

10. The fluid driven multi-mode vibration tool of claim 1, further including a spring positioned between the slot piston and the shaft to resist downward movement of the slot piston.

11. A fluid-driven multi-mode vibration tool operable by interrupting and then reinstating the flow of pressurized fluid the tool, and wherein interrupting and then reinstating the flow of pressurized fluid opens different fluid ejection paths through the tool while blocking others, comprising:

a central bore of the tool housing a shaft in a lower sub of the tool, said shaft having at least three pairs of opposed fluid ejection paths extending through it, each of said opposed ejection paths having an entrance and an exit, and the exits of said first pair of opposed ejection paths access a first pair of opposed exit ports on circumference of the tool, the exits of said second pair of opposed ejection paths access the central bore, and the exits of said third pair of opposed ejection paths access a second pair of opposed exit ports on circumference of the tool;

a rotatable slot piston above the shaft and engaged with a ratchet assembly, said ratchet assembly mounted within the tool and having a zig zag path defining a series of peaks and valleys within the central bore;

said slot piston having one or more blocked and one or more unblocked flow paths extending through it and said slot piston being engaged with the ratchet assembly such that axial movement of the slot piston causes movement to the next peak or valley in the zig zag path; and wherein, each blocked and each unblocked flow path has an entrance and an exit, and wherein the exit of each blocked and each unblocked flow path can align with an entrance of said opposed ejection paths, and wherein the exit of each blocked flow path includes a seal which can seal the entrance to said opposed ejection paths when blocked exits of the slot piston are adjacent the shaft.

12. The fluid-driven multi-mode vibration tool of claim 11 wherein the slot piston has a series of protrusions on its circumference configured to engage the zig zag path.

13. The fluid-driven multi-mode vibration tool of claim 12, wherein said protrusions are pins.

14. The fluid-driven multi-mode vibration tool of claim 11 wherein the zig zag path is defined by the lower edge of an upper ratchet ring and the upper edge of a lower ratchet ring, said upper and lower ratchet rings fixed with respect to the central bore.

15. The fluid-driven multi-mode vibration tool of claim 11 further including a centralizer fixed above the slot piston in the central bore and having a series of channels extending through the centralizer, each channel having an entrance and an exit.

16. The fluid-driven multi-mode vibration tool of claim 15 wherein said centralizer further includes an axially extending central channel accommodating a stabilizing rod which is fixed to the center of the slot piston, said stabilizing rod extends axially into a tubular cup.

17. The fluid driven multi-mode vibration tool of claim 11, wherein each path of said first pair of opposed ejection paths bifurcates into a first sub-path and a second sub-path, wherein the lower end of said first sub-paths access an inner end of a nozzle accessing the outside of the tool.

18. The fluid driven multi-mode vibration tool of claim 17, wherein each of the second sub-paths extend into an inner bore in the shaft.

19. The fluid driven multi-mode vibration tool of claim 18, wherein said inner bore further includes a flapper valve which permits flow through the shaft and to the central bore and outflow from the tool.

20. The fluid driven multi-mode vibration tool of claim 11 further including a spring positioned between the slot piston and the shaft to resist downward movement of the slot piston.

* * * * *